US007706712B2

(12) United States Patent
Shuto

(10) Patent No.: US 7,706,712 B2
(45) Date of Patent: Apr. 27, 2010

(54) IMAGE FORMING APPARATUS CAPABLE OF EFFECTIVELY COOLING DOWN A RECORDING MEDIUM AFTER A FIXING PROCESS WITH HEAT

(75) Inventor: Miwa Shuto, Yokohama (JP)

(73) Assignee: Ricoh Company Ltd., Tokyo (JP)

( * ) Notice: Subject to any disclaimer, the term of this patent is extended or adjusted under 35 U.S.C. 154(b) by 880 days.

(21) Appl. No.: 11/477,650

(22) Filed: Jun. 30, 2006

(65) Prior Publication Data

US 2007/0003314 A1 Jan. 4, 2007

(30) Foreign Application Priority Data

Jul. 1, 2005 (JP) ..... 2005-194013
May 26, 2006 (JP) ..... 2006-147110

(51) Int. Cl.
*G03G 21/20* (2006.01)
*G03G 15/20* (2006.01)
*G03G 15/00* (2006.01)

(52) U.S. Cl. ..... 399/92; 399/94; 399/341; 399/390

(58) Field of Classification Search ..... 399/92, 399/94, 341, 390
See application file for complete search history.

(56) References Cited

U.S. PATENT DOCUMENTS 7,106,986 B2 * 9/2006 Nakayama ..... 399/69
7,590,376 B2 * 9/2009 Tomita et al. ..... 399/329

FOREIGN PATENT DOCUMENTS

| | | | |
|---|---|---|---|
| JP | 2542935 | | 4/1997 |
| JP | 10-133440 | | 5/1998 |
| JP | 10-173374 | | 6/1998 |
| JP | 10247052 A | * | 9/1998 |
| JP | 11119489 A | * | 4/1999 |
| JP | 2003-241623 | | 8/2003 |
| JP | 2005-321287 | | 11/2005 |

* cited by examiner

*Primary Examiner*—David M Gray
*Assistant Examiner*—Joseph S Wong
(74) *Attorney, Agent, or Firm*—Oblon, Spivak, McClelland, Maier & Neustadt, L.L.P.

(57) ABSTRACT

An image forming apparatus capable of effectively cooling down a recording medium heated by a toner fixing unit includes a cooling mechanism having a duct, a radiating fin, and a heat pipe. The duct includes two air flow structures, each including an air inlet, an air supply path, an air exhaust path, and an air outlet. The radiating fin is arranged between the air supply path and the air exhaust path of each air flow structure. The radiating fin has a plurality of fins each radially extending in parallel to a flow of air in the duct. The heat pipe has one side connected to the radiating fin and another side arranged in a vicinity to an exit of a toner fixing mechanism. The heat pile rotates to draw heat from the heated recording sheet having a fixed toner image.

11 Claims, 27 Drawing Sheets

IMAGE FORMING APPARATUS CAPABLE OF EFFECTIVELY COOLING DOWN A RECORDING MEDIUM AFTER A FIXING PROCESS WITH HEAT

BACKGROUND OF THE INVENTION

1. Field of the Invention

The present invention relates to an image forming apparatus, and more particularly to an image forming apparatus capable of effectively cooling down a recording medium after a fixing process with heat and pressure.

2. Discussion of the Background Art

In general, an electrophotographic method is widly used in an image forming apparatus such as a copying machine, a facsimile machine, a printer, a multi-function machine, and the like. The electrophotographic method employs a series of processes such as charging, exposing, developing, transferring, fixing, and so on, to finally produce an image on a recording medium (e.g., a recording sheet). The discussion here focuses on the fixing process that follows the transferring process. In the transferring process, a recording medium receives a toner image from a photosensitive member generally by an electrostatic force. The toner image transferred onto the recording medium is unfixed but is held on the surface of the recording medium by the electrostatic force. Such a recording medium carrying an unfixed toner image thereon is then subjected to the fixing process. The fixing process typically apply heat and pressure to melt the toner and to press the melted toner onto the recording medium.

As such, the recording medium usually has a relatively high temperature after the fixing process. This phenomenon becomes evident, particularly when image are reproduced at a relatively high speed. Therefore, a high-speed image forming apparatus has been facing a problem called a blocking. This problem occurs on recording sheets having a relatively high temperature after the fixing process. More specifically, the toner image carried on the recording medium may partly be still melted and therefore fixed to another sheet. That is, the recording sheets are adhered to each other.

Several attempts to address this problem may be referred to Japanese Utility Patent No. 2542935 and Japanese Unexamined Patent Application Publication No. JP2003-241623, for example. These references describe a cooling system which uses a heat pipe for drawing heat from the heated recording medium, and a radiating fin connected to the heat pipe and radiating heat transmitted from the heat pipe. The radiating fin is encased in a duct which has an air inlet for taking in a fresh air and an air outlet for ejecting a heated air.

In this cooling system using the heat pipe and the radiating fin, in particular, a forced air cooling to cool off the radiating fin has the largest terminal resistance among other components. Accordingly, efficiently cooling the radiating fin is needed to improve a total cooling efficiency of the cooling system. Although using a cooling fan of a higher rating may be an instant solution, it may lead to an environmental problem such as an increase of a manufacturing cost and a noise.

In a conventional background image forming apparatus, a radiating fin having a plurality of disc-like-shaped fins is encased in a cooling duct and is connected to a heat pipe which rotates together with the radiating fin when drawing heat from a recording sheet. The heat of the recording sheet is transmitted through the heat pipe to the plurality of fins of the radiating fin. In the cooling duct, air is blown to the plurality of fins of the radiating fin so as to cool down the fins.

FIG. 1 illustrates a typical air flow in a cooling duct encasing a radiating fin 1. As illustrated in FIG. 1, the air flow is divided into two air streams when impinging on the radiating fin 1 in the cooling duct. One air stream clearly appears to enter into gaps between fins of the radiating fin 1. In this part of the radiating fin 1, the air stream flows in a direction substantially same as a rotation direction of the radiating fin 1. However, the other air stream appears to flow away from the radiating fin 1. In this part of the radiating fin 1, the air stream flows in a direction substantially opposite to a rotation direction of the radiating fin 1. That is, it is experimentally understood that the forced air cooling does not use almost a half of the air flow.

In addition, FIG. 2 illustrates a profile of an air flow speed generated by a cooling fan 2. As illustrated in FIG. 2, the air flow speed is not flat, that is, two peaks on edges sandwiches a flat hollow. Specifically, the air flow speed has a peak on a circumferential region of the cooling fan, and stays a relatively low level in an inner radius region. When such an air flow having an uneven speed impinges on the radiating fin, a middle part of the radiating fin may not efficiently be cooled down.

SUMMARY OF THE INVENTION

The present patent specification describes a novel image forming apparatus which effectively cools down a recording medium heated by a toner fixing unit. In one example, a novel image forming apparatus includes, an image forming mechanism, a toner fixing mechanism, and a cooling mechanism. The image forming mechanism is configured to form a toner image on a recording sheet. The toner fixing mechanism is configured to heat the toner image on the recording sheet for fixing. The cooling mechanism is configured to cool down the heated recording sheet having the fixed toner image. This cooling mechanism includes a duct, a radiating fin, and a heat pipe. The duct includes first and second air flow structures, each of which includes an air inlet, an air supply path, an air exhaust path, and an air outlet, in this order to take in air through the air inlet and to eject the air through the air outlet via the air supply path and the air exhaust path in each of the first and second air flow structures. The radiating fin is arranged in the duct between the air supply path and the air exhaust path of each of the first and second air flow structures. The radiating fin has a plurality of fins each radially extending in parallel to a flow of air in the duct. The heat pipe has one side connected to the radiating fin and another side arranged in a vicinity to an exit of the toner fixing mechanism. The heat pile is configured to rotate to draw heat from the heated recording sheet having the fixed toner image.

The present specification further describes a novel image forming apparatus which effectively cools down a recording medium heated by a toner fixing unit. In one example, a novel image forming apparatus includes an image forming mechanism, a toner fixing mechanism, and a cooling mechanism. The image forming mechanism is configured to form a toner image on a recording sheet. The toner fixing mechanism is configured to heat the toner image on the recording sheet for fixing. The cooling mechanism is configured to cool down the heated recording sheet having the fixed toner image. The cooling mechanism includes a duct, a radiating fin, and a heat pipe. The duct includes an air inlet, an air supply path, an air exhaust path, and an air outlet, in this order to take in air through the air inlet and to eject the air through the air outlet via the air supply path and the air exhaust path. The radiating fin is arranged in the duct between the air supply path and the air exhaust path. The radiating fin includes a plurality of fins each radially extending in parallel to a flow of air in the duct. The heat pipe has one side connected to the radiating fin and another side arranged in a vicinity to an exit of the toner fixing mechanism. The heat pipe is configured to rotate to draw heat from the heated recording sheet having the fixed toner image. In this cooling mechanism, the duct satisfies at least one of inequalities ZA<ZB and ZC<ZB, wherein ZA is a cross-section area of the air supply path, ZB is an inside cross-section area of the duct around the radiating fin, and ZC is a cross-section area of the air exhaust path.

This patent specification further describes a novel cooling apparatus which cools down a heated recording sheet having a fixed toner image in an image forming apparatus. In one example, a novel cooling apparatus includes a duct, a radiating fin, and a heat pipe. The duct includes first and second air flow structures, each of which includes an air inlet, an air supply path, an air exhaust path, and an air outlet, in this order to take in air through the air inlet and to eject the air through the air outlet via the air supply path and the air exhaust path in each of the first and second air flow structures. The radiating fin is arranged in the duct between the air supply path and the air exhaust path of each of the first and second air flow structures, and has a plurality of fins each radially extending in parallel to a flow of air in the duct. The heat pipe has one side connected to the radiating fin and another side arranged in a vicinity to an exit of a toner fixing mechanism of the image forming apparatus, and is configured to rotate to draw heat from the heated recording sheet having the fixed toner image.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
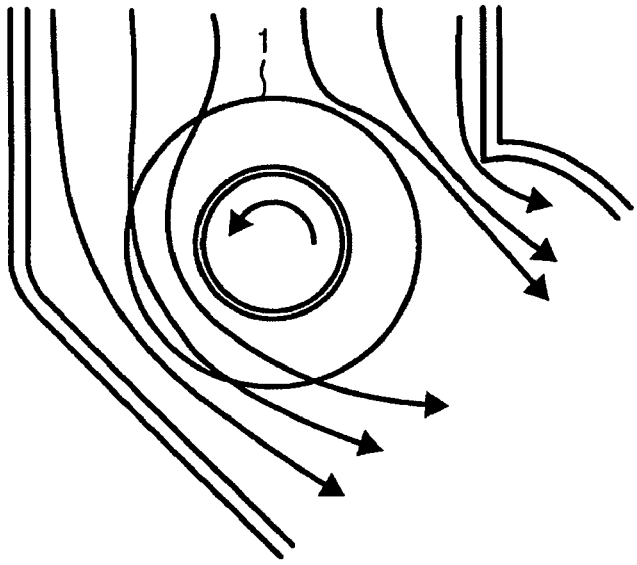
FIG. 1 PRIOR ART
FIG. 1 is an illustration for explaining an air flow inside a cooling duct of a recording-sheet cooling system of a background image forming apparatus.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 3, a copying machine 1 is explained as one example of an image forming apparatus according to an exemplary embodiment of the present invention. Although the copying machine 1 is exemplified, the exemplary embodiment of the present invention can also be applied to other machines such as, for example, a facsimile machine and a printer as well as a copy-fax-print combination machine generally called a multi-function machine.

Figure 3:
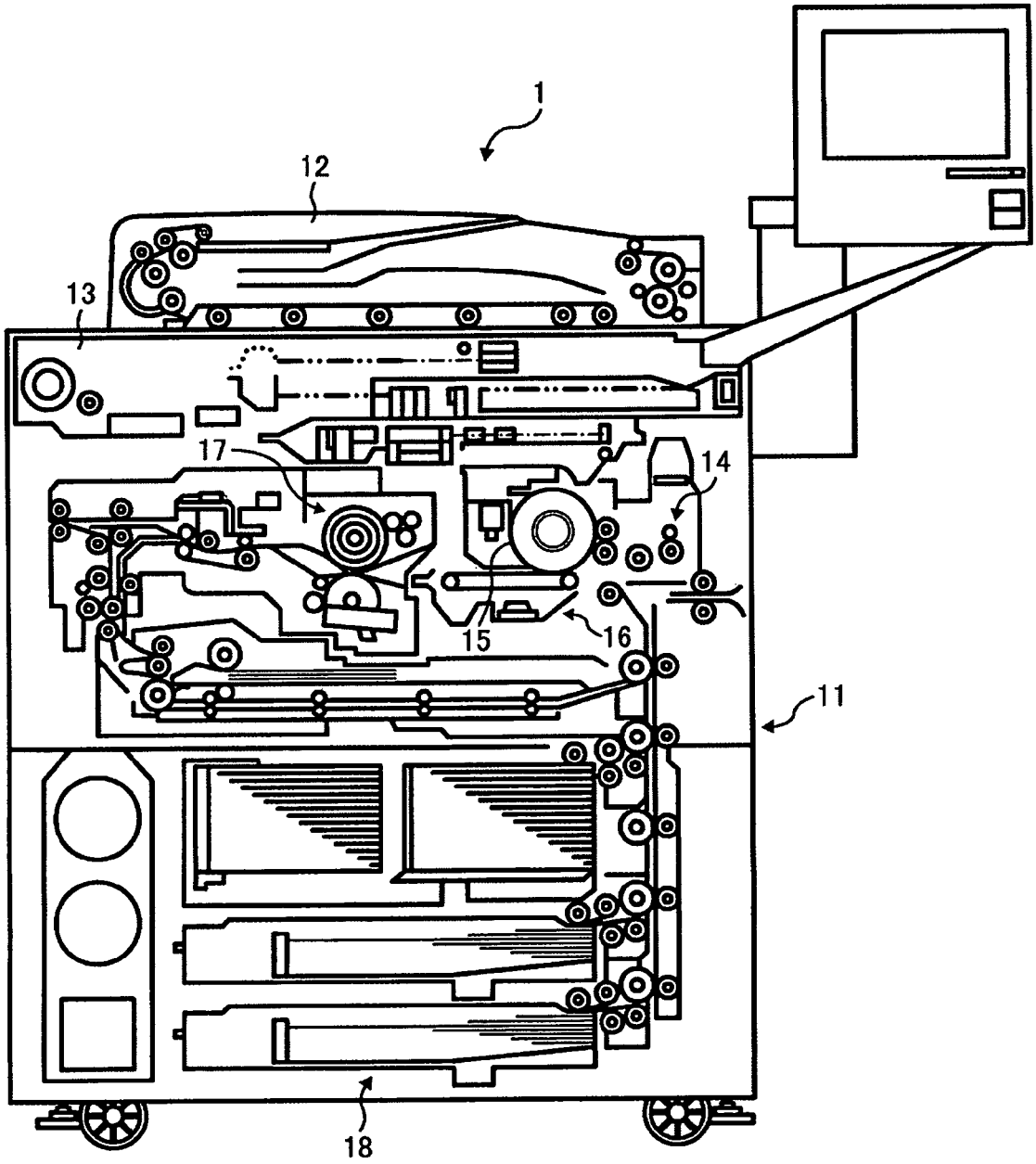
FIG. 3 is a schematic diagram of an image forming apparatus according to an exemplary embodiment of the present invention.

As illustrated in FIG. 3, the copying machine 1 includes a frame 11, an ADF (automatic document feeder) 12, a scanner 13, an image development unit 14, a photosensitive drum 15, an image transfer unit 16, a toner fixing unit 17, and a sheet supply unit 18. The copying machine 1 further includes a cooling mechanism 24 (see FIG. 6) which is disposed behind the above-mentioned copying mechanisms and is therefore not shown in FIG. 3.

The frame 11 provides an inner space to support and accommodate units and components including the above-mentioned constituents from the ADF 12 through the sheet supply unit 18, as well as the cooling mechanism 24. The ADF 12 transports an original document to a reading position. The scanner 13 reads an original document placed at the reading position and outputs image data of the read original document. The image development unit 14 develops an electrostatic latent image formed according to the image data into a visual image with toner. The photosensitive drum 15 evenly carries charges on a surface thereof and an electrostatic latent image after an exposure of the charged surface to a light beam according to the image data. The image transfer unit 16 transfers the toner image carried on the surface of the photosensitive drum 15 onto a recording medium (e.g., a recording sheet). The toner fixing unit 17 fixes toner of the toner image on the recording medium. The sheet supply unit 18 contains a relatively large number of recording medium.

The copying machine 1 of FIG. 3 forms an image forming mechanism by various constituents including the scanner 13, the image development unit 14, the photosensitive drum 15, the image transfer unit 16, and the toner fixing unit 17.

Figure 4:
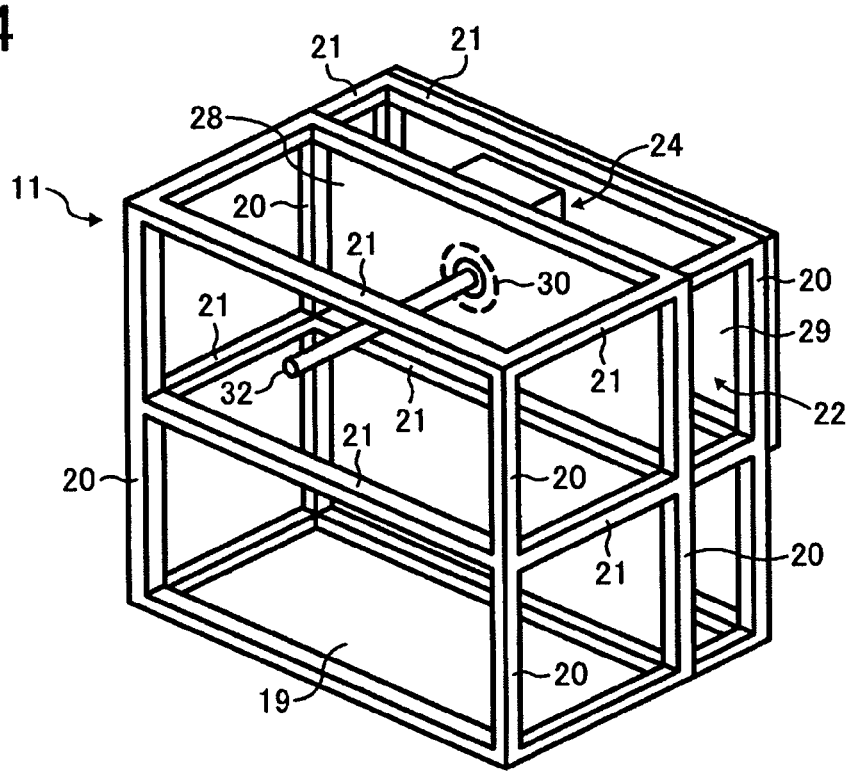
FIG. 4 is an oblique front view of a frame structure of the image forming apparatus of FIG. 3.
Figure 5:
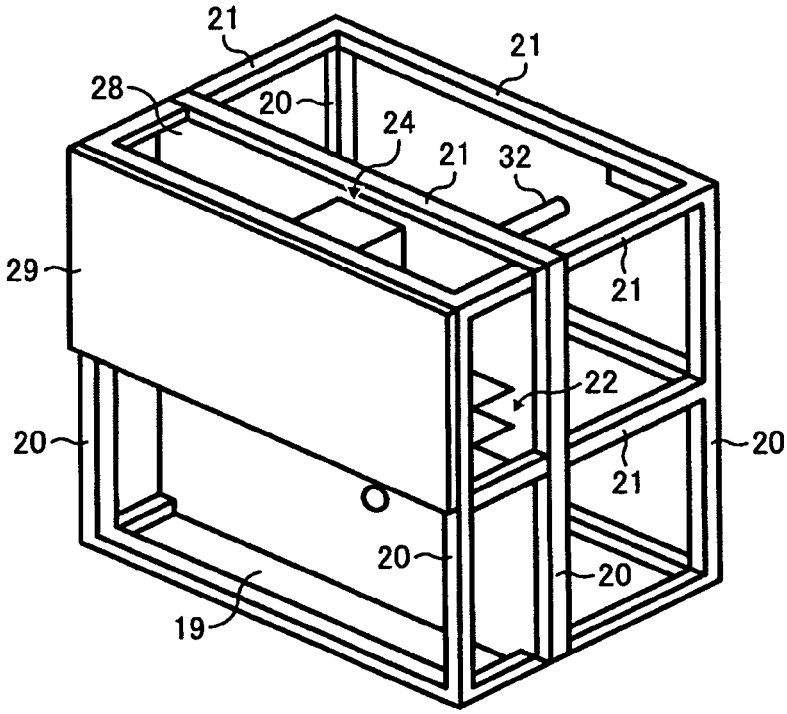
FIG. 5 is an oblique rear view of the frame structure of the image forming apparatus of FIG. 3.

Referring to FIGS. 4-7, a structure of the frame 11 is explained in details. As illustrated in FIG. 4, the frame 11 includes a bottom plate 19, a plurality of pillars 20, and a plurality of beams 21. The plurality of pillars 20 are mounted on edges of the bottom plate 19 and are connected to each other by the plurality of beams 21. In FIG. 4, the frame 11 forms an inner space which is divide by a partition panel 28 into a front section and a rear section which is referred to as a duct chamber 22. The frame 11 further includes a rear cover 29 which is provided in parallel to the partition panel 28 to externally cover the duct chamber 22, as illustrated in FIG. 5.

Figure 6:
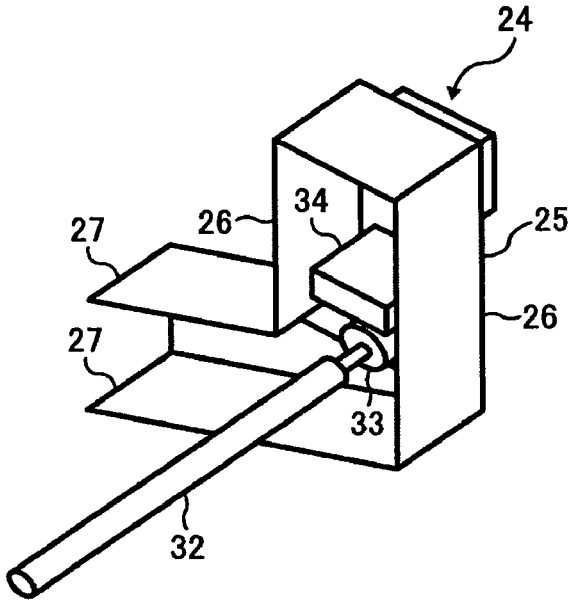
FIG. 6 is a perspective view of a recoding-sheet cooling system of the image forming apparatus of FIG. 3.

The above-mentioned cooling mechanism 24 is provided inside the duct chamber 22. As illustrated in FIG. 6, the cooling mechanism 24 includes a duct 25. The duct 25 is formed by a pair of first duct plates 26 disposed in parallel to each other with a predetermined distance and a pair of second duct plates 27 disposed in parallel to each other with a predetermined distance. These first and second duct plates 26 and 27 are connected to each other to form an upper surface and a bottom surface. Open sides between the first and second duct plates 26 and 27 are covered by the partition panel 28 and the rear cover 29.

Figure 7:
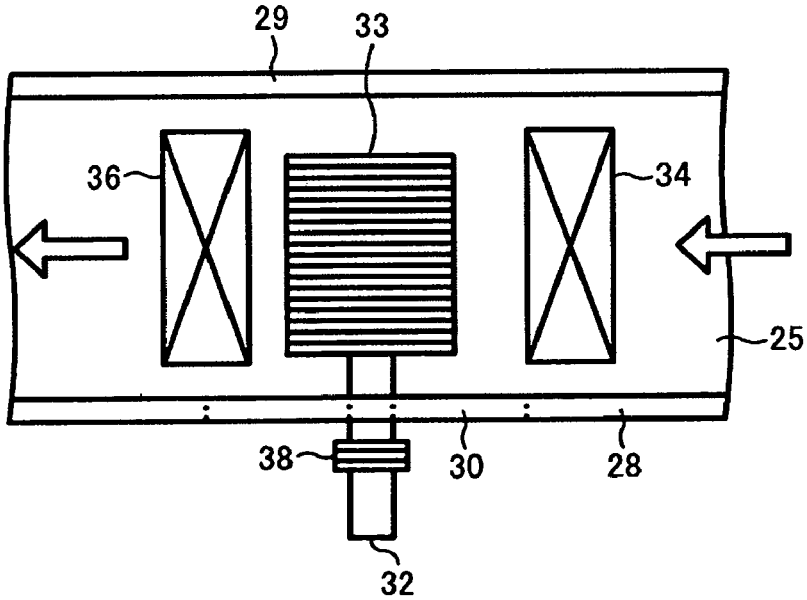
FIG. 7 is a schematic diagram for explaining a positional relationship between a radiating fin and cooling fans.

As illustrated in FIG. 7, the partition panel 28 has an opening 30 to make the front section and the rear section communicate with each other. The opening 30 is used for installation of the radiating fin 33 inside the duct 25. The cooling mechanism 24 further includes a heat pipe 32 and a radiating fin 33. The radiating fin 33 includes a plurality of fins having a disc-like shape. The cooling mechanism 24 operates to cool off the recording medium heated by the toner fixing unit 17. The heat pipe 32 is held for rotation and has one end connected to the radiating fin 33. Another end of the heat pipe 32 is projected from the partition panel 28 through the opening 30 into the front section of the frame 11. The heat pipe 32 in the front section is arranged in a vicinity to an exit of the toner fixing unit 17, and is caused to rotate in contact with the recording medium being ejected from the toner fixing unit 17 so as to absorb heat of the recording medium.

Figure 8A:
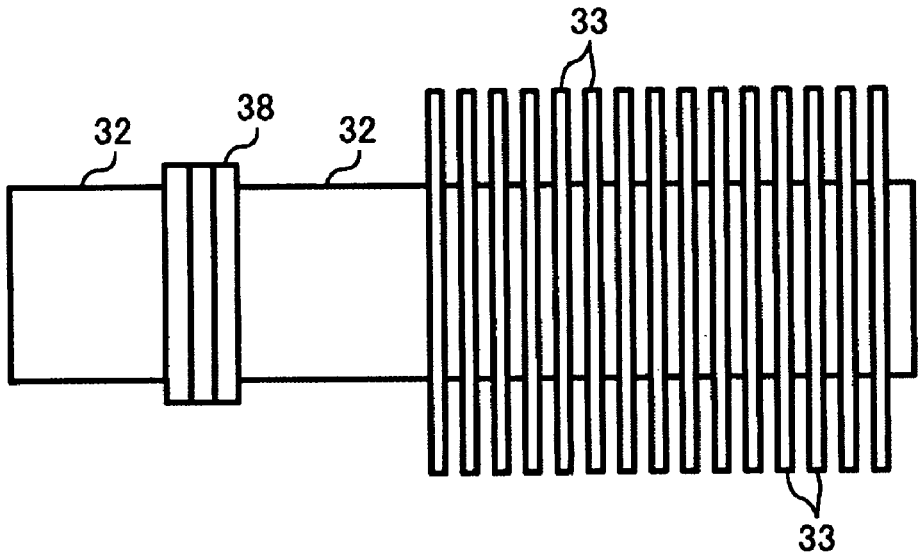
FIG. 8A is a schematic diagram of a heat pipe and the radiating fin.
Figure 8B:
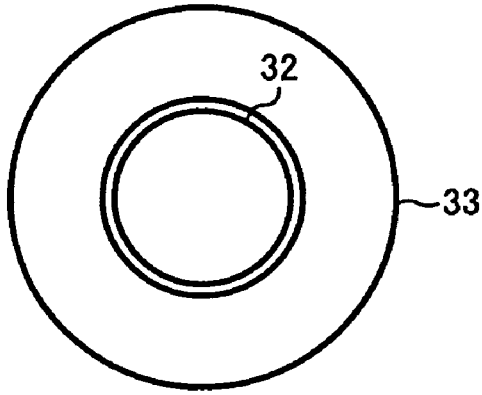
FIG. 8B is a cross sectional view of the heat pipe and the radiating fin.

As also illustrated in FIG. 7, the cooling mechanism 24 further includes two air supply fans 34 and two air exhaust fans 36 which are mounted inside the duct 25. FIG. 7 illustrates an inside view of the duct 25 in a direction perpendicular to the heat pipe 32. In FIG. 7, a single pair of the air supply fan 34 and the air exhaust fan 36 is shown and another pair of the air supply fan 34 and the air exhaust fan 36 is arranged behind. The pairs of the air supply fans 34 and the air exhaust fans 36 are arranged inside the duct 25 at positions opposite to each other relative to the radiating fin 33. As illustrated in FIGS. 8A and 8B, the heat pipe 32 is extended with another heat pipe 32 via a connector 38. The radiating fin 33 is fixed around a circumference of the heat pipe 32 and each fin of the radiating fin 33 is arranged approximately in a direction perpendicular to an axial direction of the heat pipe 32.

Figure 9:
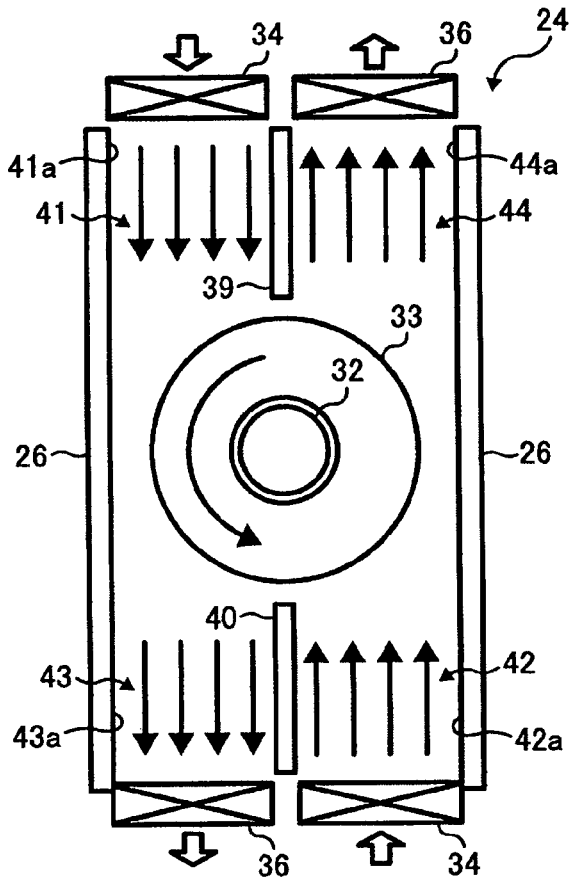
FIG. 9 is an interior view of a cooling duct in cross section of the recording-sheet cooling system of FIG. 6.

As illustrated in FIG. 9, the duct 25 is internally provided with partition plates 39 and 40 which divides an inside space of the duct 25 into two air supply paths and two air exhaust paths. The two air supply paths are an air supply path 41 with an air inlet 41*a* and an air supply path 42 with an air inlet 42*a*. The two air exhaust paths are an air exhaust path 43 with an air outlet 43*a* and an air exhaust path 44 with an air outlet 44*a*.

The air supply path 41 and the air exhaust path 43 are connected in series to each other. The air supply fan 34 is mounted at the air inlet 41*a* and the air exhaust fan 36 is provided at the air outlet 43*a* so as to make a straight air flow. Also, the air supply path 42 and the air exhaust path 44 are connected in series to each other. The air supply fan 34 is mounted at the air inlet 42*a* and the air exhaust fan 36 is provided at the air outlet 44*a* so as to make a straight air flow. Since a combination of the air supply path 41 and the air exhaust path 43 is opposite to a combination of the air supply path 42 and the air exhaust path 44, the air flows are provided in directions opposite to each other, as illustrated in FIG. 9. Each of the air flows is in a forward direction relative to a direction of the radiating fin 33, as illustrated in FIG. 9.

Figure 10:
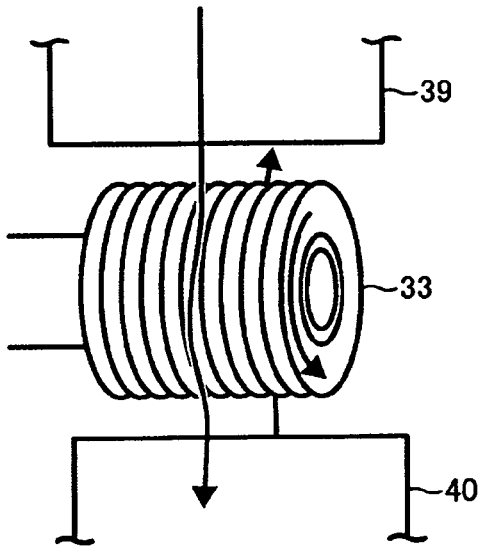
FIG. 10 is an illustration for explaining a direction of an air flow matching a direction of the radiating fin.

In this example, the air supply fans 34 and the air exhaust fans 36 are driven to make air flows from the air supply paths 41 and 42 to the air exhaust paths 43 and 44, respectively, as illustrated in FIG. 9. In the middle of the air path, the flowing air collides with the radiating fin 33 rotating in a direction same as the direction of the air flow, as illustrated in FIG. 10. That is, the radiating fin 33 contacts the flowing air for a certain time period and is cooled off. Consequently, the heat pipe 32 connected to the radiating fin 33 is cooled off.

With this structure, the heat pipe 32 can effectively cooled off so that the cooling mechanism effectively operate to cool down the recording medium efficiently at an exit from the toner fixing unit 17. In addition, since the cooling efficiency of the heat pipe 32 can be reduced, it is possible to use an air supply fan having a relatively low rating. This leads to effects of an energy saving as well as a noise reduction.

Figure 13:
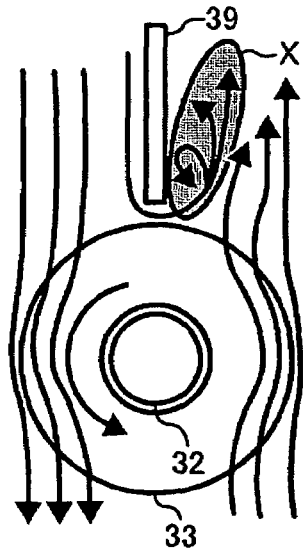
FIG. 13 is an illustration for explaining a disturbance of air flow caused due to a relatively wide gap between the radiating fin and a partition plate.

With this structure, however, if a gap between the partition plate 39 (or the partition plate 40) and the radiating fin 33 is relatively large, a part of the air flowing in the air supply path 41 enters into the air exhaust path 44, as indicated by a letter X in FIG. 13. Thus, the gap may produce a loss of air flow. Therefore, the gap may preferably be as small as possible.

Figure 14:
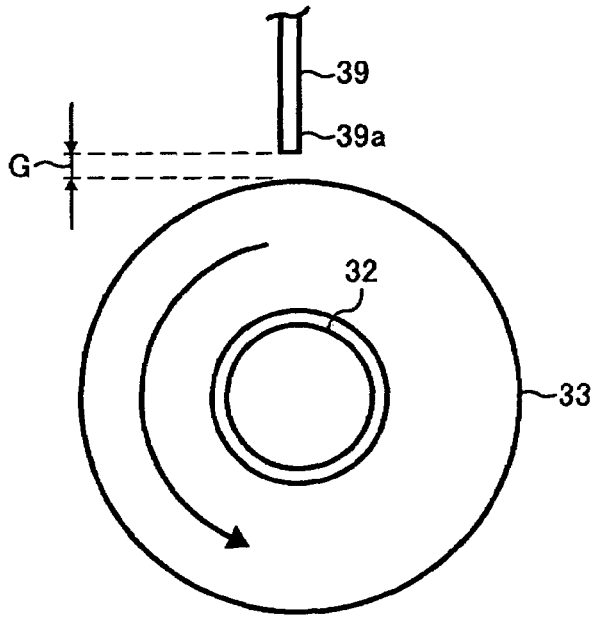
FIG. 14 is an illustration for explaining a preferable gap between a leading edge of the partition plate and the radiating fin.

However, there is a limit to a reduction of the gap since the cooling mechanism including the heat pipe 32 needs to be detachable to allow an operator access to an interior of the copying machine 1 at an event of machine failure such as a paper jam, for example. A preferable gap G, indicated in FIG. 14, between the partition plate 39 (specifically a top edge 39*a*) and the radiating fin 33 is in a range of from approximately 3 mm to approximately 5 mm. This preferable gap may equally be applied to each one of exemplary embodiments described below although the explanation may not be repeated.

Figure 11:
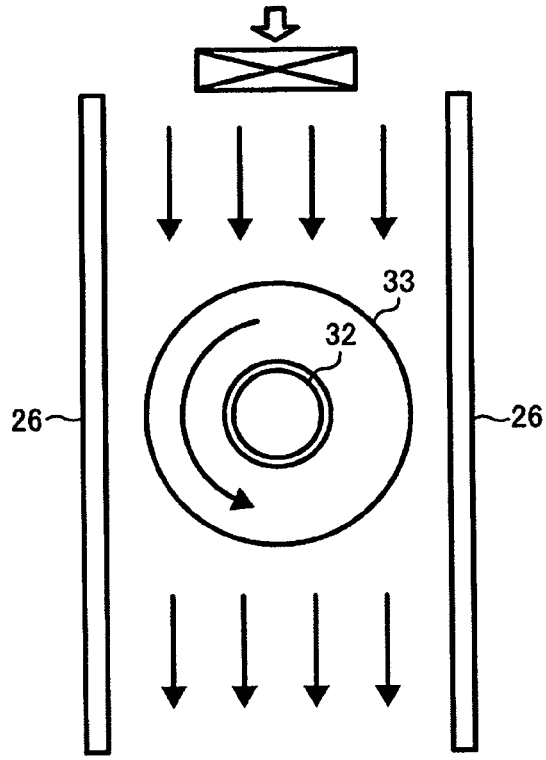
FIG. 11 is a comparative example having a single cooling fan.
Figure 12:
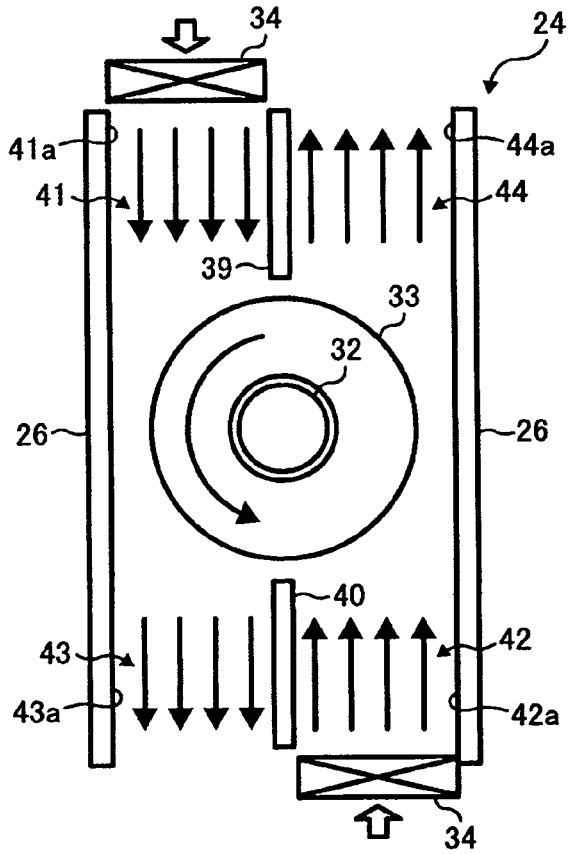
FIG. 12 is another comparative example eliminating two exhaust fans.

As an alternative, it may be possible to provide the duct 25 with the air supply fans 34 at the air inlets 41*a* and 42*a* but not to provide the air exhaust fans 36 neither at the air outlets 43*a* nor 44*a*, as illustrated in FIG. 12. Although it is not shown, it may also be possible to provide the duct 25 with the air exhaust fans 36 at the air outlets 43*a* and 44*a* but not to provide the air supply fans 34 neither at the air inlets 41*a* nor 42*a*. According to Applicant experimental results, even these alternative examples using two fans successively reduced a heat resistance by 52% in comparison with a comparative example of a duct that simply had a single air supply fan 34, as illustrated in FIG. 11.

Figure 15:
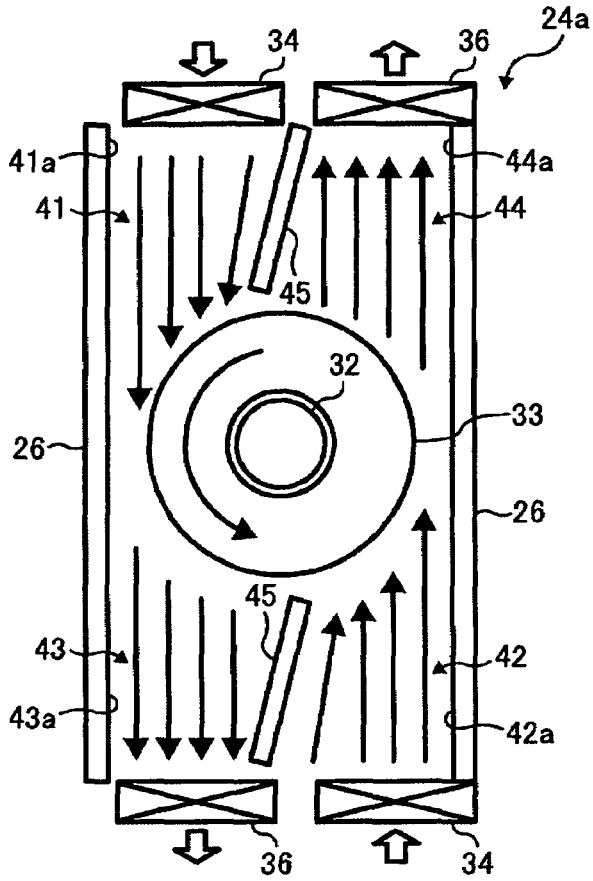
FIG. 15 is a cross-section view of a cooling duct having slant partition plates according to another embodiment of the present invention.
Figure 16:
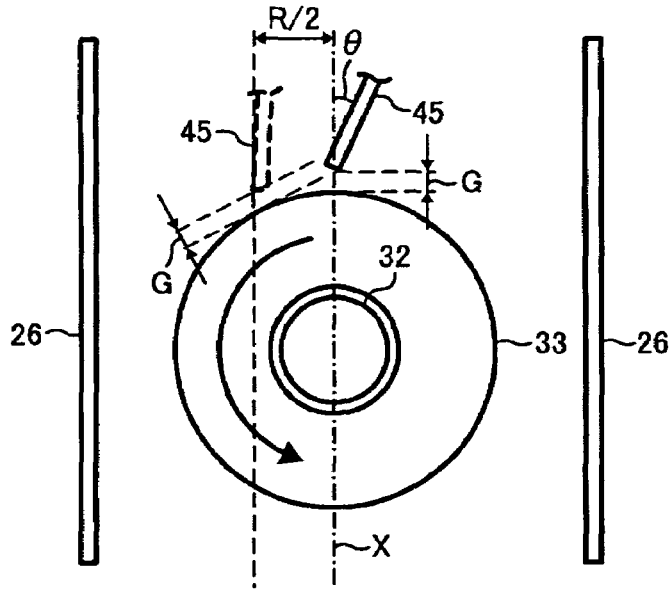
FIG. 16 is an illustration for explaining a physical relationship between the slant partition plates and the radiating fin of the cooling duct of FIG. 15.

Referring to FIGS. 15 and 16, a cooling mechanism 24*a* according to another embodiment of the present invention is explained. The cooling mechanism 24*a* is, as illustrated in FIG. 15, similar to the cooling mechanism 24 of FIG. 9, except for partition plates 45 which are tilted in a direction opposite to the rotation direction of the radiating fin 33. Thus, the air supply path 41 (and the air supply path 42) is provided with a slope by the partition plate 45 so that the air flowing in the air supply path 41 is narrowed and accelerated as coming closer to the radiating fin 33. In addition, with this slope of the partition plate 45, the air flowing along the slope is directed to the radiating fin 33 and is caused to collide with the radiating fin 33 with an angle smaller than a right angle. This effect avoids an unexpected air flow into the gap G of FIG. 13, resulting in a further improvement of the cooling effect.

When the tilt angle of the partition plate 45 is too small, the improvement may not be sufficient. But, when the tilt angle of the partition plate 45 is too large, the flowing air may not enter into space between the fins of the radiating fin 33, resulting in an inefficiency of cooling.

Therefore, each of the partition plates 45 is preferably arranged at a position such that an edge portion of the partition plate 45 is positioned within a range of half a radius R of the radiating fin 33 from a center axis X of the radiating fin 33, as illustrated in FIG. 16.

With the gap G in a range of from approximately 3 mm to approximately 5 mm, a tilt angle θ of the partition plate 45 is preferably set to approximately 15 degrees at maximum when the edge portion is positioned approximately at the center axis X of the radiating fin 33. But, the partition plate 45 is preferably set to a position approximately parallel to the center axis X of the radiating fin 33, that is, the tile angle θ is 0, when the edge portion is positioned approximately at an end of half the radius R of the radiating fin 33.

In this way, the cooling mechanism 24 of the copying machine 1 has a structure in which the partition plate 45 is tilted in a direction opposite to the rotation direction of the radiating fin 33 so that the flowing air in the air supply path 41 is narrowed as it comes closer to the radiating fin 33. As a result, the air flow speed may be accelerated and the air flow may not be disturbed by an air turbulence at a top edge of the partition plate 45. Therefore, the cooling effect of the heat pipe 32 may be enhanced, thereby efficiently cooling down the heated recording sheet.

In addition, as the cooling effect of the heat pipe 32 can be improved in such a way, it may be possible to use air supply fans and air exhaust fans both having relatively low ratings. This leads to the energy saving and the noise reduction.

Figure 17:
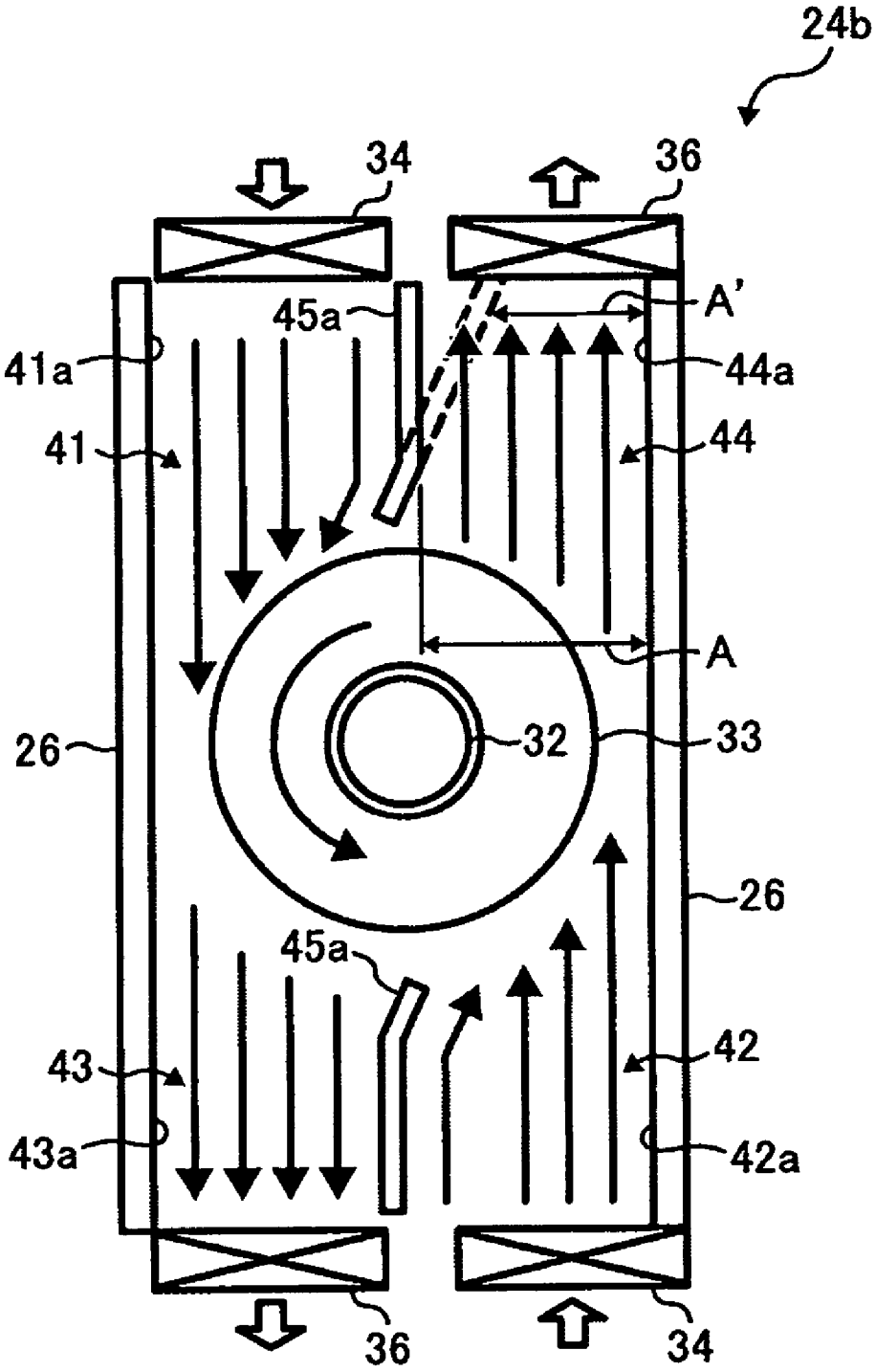
FIG. 17 is a cross-section view of a cooling duct having slightly bent partition plates according to another embodiment of the present invention.
Figure 18:
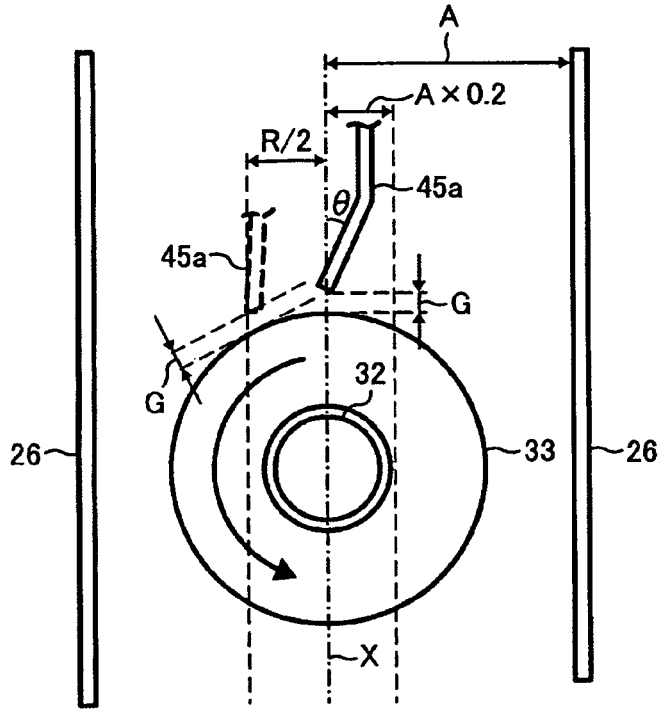
FIG. 18 is an illustration for explaining a physical relationship between the slightly bent partition plates and the radiating fin of the cooling duct of FIG. 17.
Figure 19:
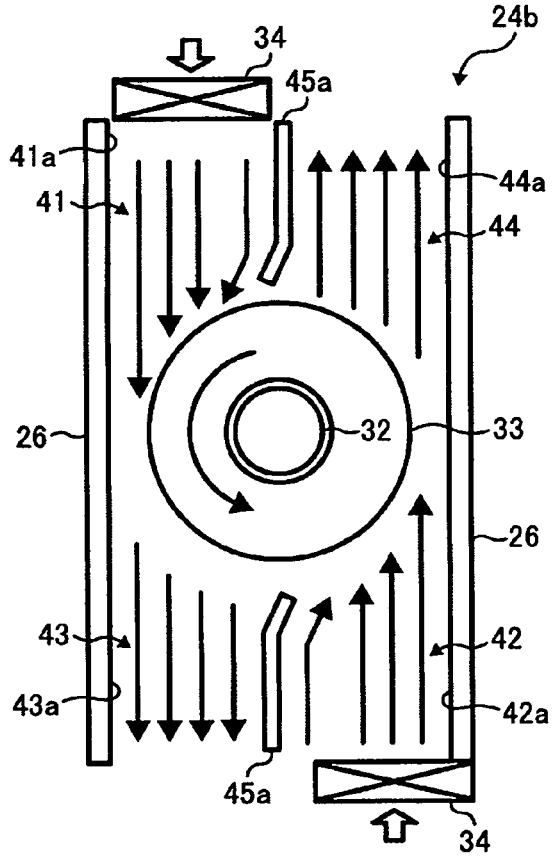
FIG. 19 is a cross-section view of a cooling duct according to another embodiment of the present invention, which eliminates air exhaust fans from the cooling duct of FIG. 17.

Referring to FIGS. 17-19, a cooling mechanism 24*b* according to another embodiment of the present invention is explained. The cooling mechanism 24*b* is, as illustrated in FIG. 17, similar to the cooling mechanism 24*a* of FIG. 15, except for partition plates 45*a* each of which includes a main portion and a leading portion. The leading portion faces the radiating fin 33, has a length shorter than the main portion, and is bent relative to the main portion. The partition plate 45*a* is disposed inside the duct 25 in a way such that the main portion is parallel to directions of the air flows and the leading portion is bent in a direction opposite to the rotation direction of the radiating fin 33.

As illustrated by ghost lines of the partition plate 45*a* in FIG. 17, the air exhaust path 44, for example, is narrowed, i.e., a width A of the air outlet 44*a* is narrowed to a width L', if the partition plate 45*a* is merely tilted. The narrowing air exhaust path may interfere a smooth air exhaustion and, in addition, it may induce a backward air flow from the air inlet 41*a*. This results in a degradation of the cooling efficiency.

As described above, the length of the leading portion is shorter than the main portion. However, if the leading portion is too short, it cannot produce a sufficient cooling effect. On the other hand, if the leading portion is too long, it may cause an interference with the air flow in the air exhaust path. In this example, the length of the leading portion is preferably within a range of from approximately 20 mm to a value which corresponds to a reduction rate of the width A of the air outlet 44*a* smaller than 20%, as illustrated in FIG. 18.

Thus, this arrangement can efficiently produce a cooling effect similar to or superior to the examples illustrated in FIGS. 9 and 15. In this example, as illustrated in FIG. 18, the basic positional relationship between the partition plate 45*a* and the radiating fin 33 is same as those illustrated in FIG. 16. That is, the basic positional relationship includes the gap between the leading edge of the partition plate 45*a* and the radiating fin 33. It also includes the basic and allowable positions of the partition plates 45*a* relative to the center axis X of the radiating fin 33.

As an alternative, the two air exhaust fans 36 may be eliminated from the cooling mechanism 24*b*, as illustrated in FIG. 19. Even with such an elimination, the cooling mechanism can reduce a thermal resistance by 56% according to an experimental result performed by Applicant.

Figure 20:
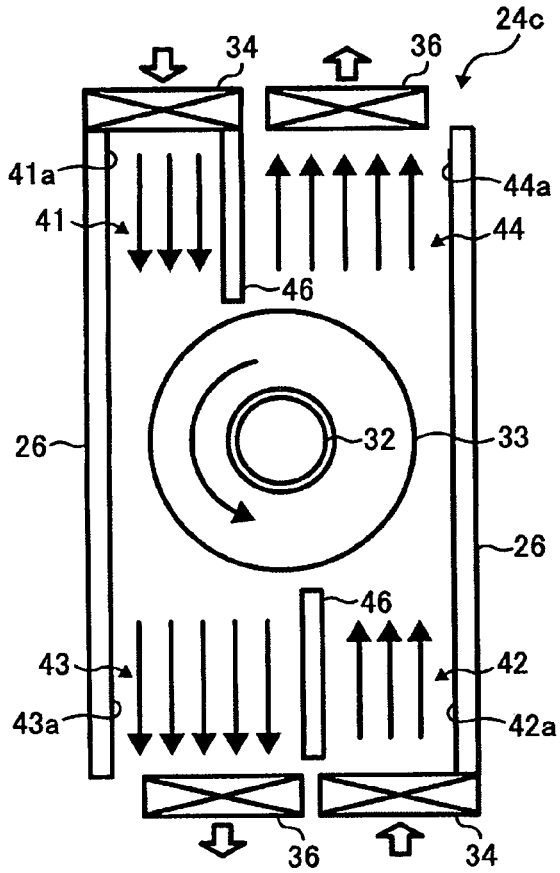
FIG. 20 is a cross-section view of a cooling duct having parallely displaced partition plates according to another embodiment of the present invention.
Figure 21:
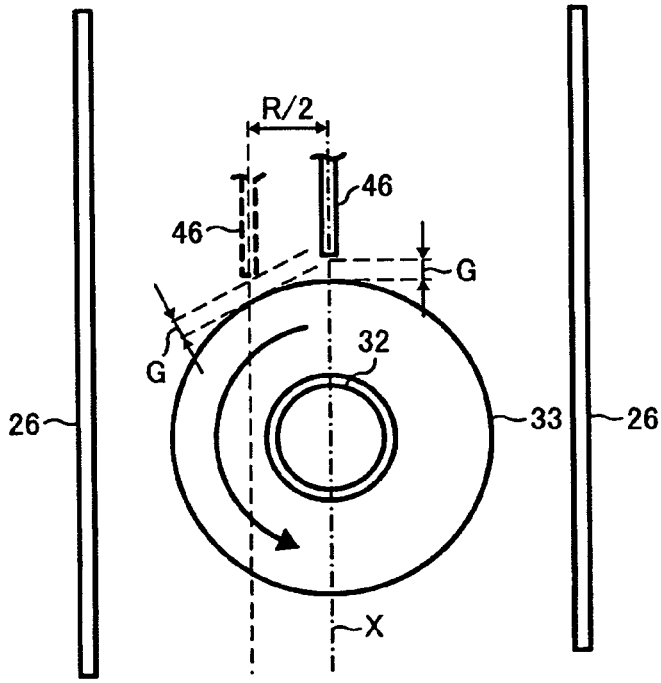
FIG. 21 is an illustration for explaining a physical relationship between the parallely displaced partition plates and the radiating fin of the cooling duct of FIG. 20.

Referring to FIGS. 20-21, a cooling mechanism 24*c* according to another embodiment of the present invention is explained. The cooling mechanism 24*c* is, as illustrated in FIG. 20, similar to the cooling mechanism 24 of FIG. 9, except for partition plates 46 each of which is formed at a position making the air supply path 41 (or 42) narrower and the air exhaust path 44 (or 43) wider. More specifically, the partition plate 46 provided to separate the air inlet 41*a* from the air outlet 44*a* is positioned closer to the first duct plate 26 connected to the air inlet 41*a* and the air outlet 43*a* than to the first duct plate 26 connected to the air inlet 42*a* and the air outlet 44*a*. The other partition plate 46 provided to separate the air inlet 42*a* from the air outlet 43*a* is positioned closer to the first duct plate 26 connected to the air inlet 42*a* and the air outlet 44*a* than to the first duct plate 26 connected to the air inlet 42*a* and the air outlet 44*a*.

As illustrated in FIG. 20, the air supply path 41 is narrowed and therefore the speed of the air flow may be accelerated. At the same time, the air exhaust path 44 is widened so as not to interfere the air flow in the air exhaust path 44. In addition, this arrangement avoids an occurrence of an air turbulence at the leading edge of the partition plate 46, as illustrated in FIG. 13.

Thus, this arrangement can efficiently produce a cooling effect in a manner similar to or superior to the examples of FIGS. 9, 15, and 17. In this example, as illustrated in FIG. 21, the basic positional relationship between the partition plate 46 and the radiating fin 33 is same as those illustrated in FIG. 16. That is, the basic positional relationship includes the gap between the leading edge of the partition plate and the radiating fin. It also includes the basic and allowable positions of the partition plates 45*a* relative to the center axis X of the radiating fin 33.

Figure 22:
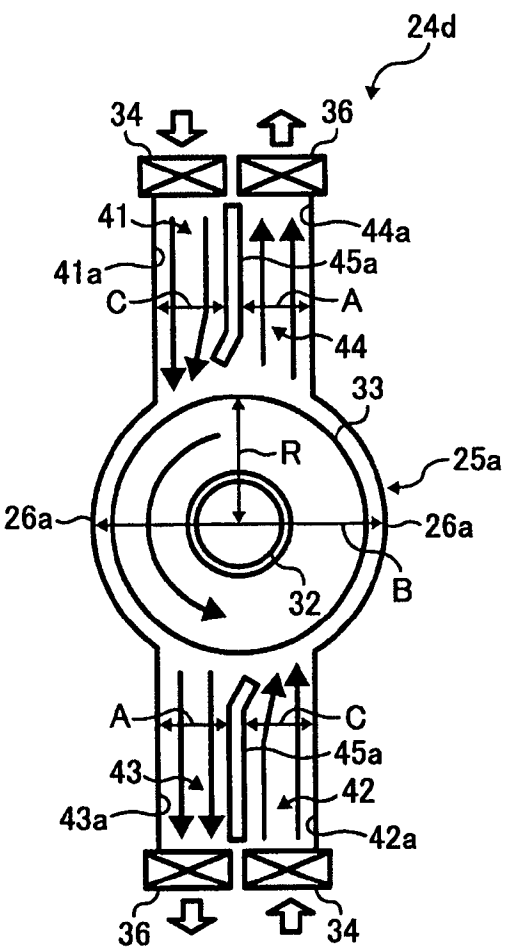
FIG. 22 is a cross-section view of a cooling duct having narrow width and slightly bent partition plates according to another embodiment of the present invention.

Referring now to FIG. 22, a cooling mechanism 24*d* according to another embodiment of the present invention is explained. The cooling mechanism 24*d* is, as illustrated in FIG. 22, similar to the cooling mechanism 24*b* of FIG. 17, except for a duct 25*a* formed by a pair of first duct plates 26*a*. As illustrated in FIG. 22, the pair of the first duct plates 26*a* forms a specific shape. In FIG. 22, a letter A defines a width of each of the main portions of the air exhaust paths 43 and 44. A letter B defines an internal distance between the pair of first duct plates 26*a*. A letter C defines a width of each of main portions of the air supply paths 41 and 42. The specific shape of the first duct plates 26*a* satisfies relationships B/2>A and B/2>C.

With this arrangement, the air taken in through the air inlets 41*a* (and 42*a*) is primarily narrowed by the width C of the air supply path 41 (and 42) which is smaller than half the radius R of the radiating fin 33. The flowing air is then further narrowed into an air jet by the leading portion of the partition plate 45*a*. When the flowing air in the air supply path 41 (and 42) reaches the radiating fin 33, the flowing air enters space of the radiating fin 33 which is a wider area having at least a width of radius R of the radiating fin 33. The air further flows halfway around the radiating fin 33. After flowing halfway around the radiating fin 33, the flowing air enters the air exhaust path 43 (and 44) having the width A and is therefore narrowed into an air flow with a width of A, resulting in an accelerated speed of the air flow. The narrowed flowing air is then ejected outside via the air outlet 43*a* (and 44*a*) by the air exhaust fan 36.

The flowing air can easily enters between the gaps of fins of the radiating fin 33 by, as described above, being narrowed into an air jet in the air supply path 41 and being blown to the fins of the radiating fin 33. To make this more effective, the width C of the air supply path 41 (and 42) needs to be smaller than half the radius R of the radiating fin 33.

With this arrangement, it becomes possible to intensively blow cooled air on the radiating fin 33 so as to effectively cool down the heat pipe 32. As a result, the heated recording sheet can efficiently be cooled off.

In addition, since the cooling efficiency of the heat pipe 32 can be reduced, it is possible to use air supply fans and air exhaust fans having relatively low ratings. This leads to the energy saving and the noise reduction.

Since the cooling mechanism 24*d* applies the specific shape of the first duct plates 26*a* satisfying relationships B/2>A and B/2>C, it can effectively be made in a relatively compact size.

As an alternative, the two air exhaust fans 36 may be eliminated from the cooling mechanism 24*d* in a manner similar to the cooling mechanism 24*b*, as illustrated in FIG. 19.

Figure 23:
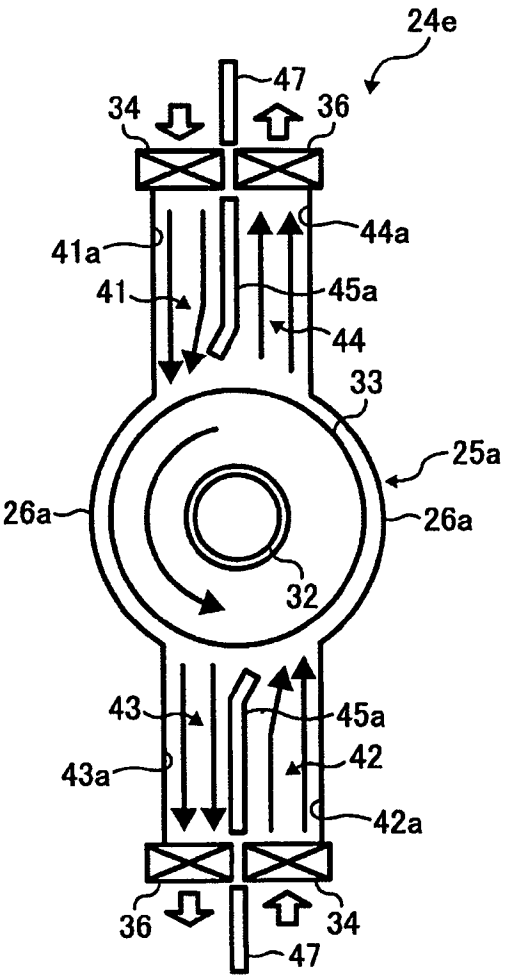
FIG. 23 is a cross-section view of a cooling duct having external partition plates according to another embodiment of the present invention.

Referring now to FIG. 23, a cooling mechanism 24*e* according to another embodiment of the present invention is explained. The cooling mechanism 24*e* is, as illustrated in FIG. 23, similar to the cooling mechanism 24*d* of FIG. 22, except for external partition plates 47. The external partition plate 47 is a partition disposed at each side of the duct 25*a*. More specifically, at the side of the air inlet 41*a* and the air outlet 44*a*, for example, the external partition plate 47 is disposed at a position on an extension of the main portion of the partition plate 45*a* and outside the air supply fan 34 and the air exhaust fan 36.

With this structure having the external partition plates 47, it becomes possible to prevent a mixture of fresh air at the air supply fans 34 with the heated air ejected from the air exhaust fans 36. Thus, the cooling mechanism 24*e* can effectively cool down the heat pipe 32. As a result, the heated recording sheet can efficiently be cooled off.

As an alternative, the two air exhaust fans 36 may be eliminated from the cooling mechanism 24*e* in a manner similar to the cooling mechanism 24*b*, as illustrated in FIG. 19.

Figure 24:
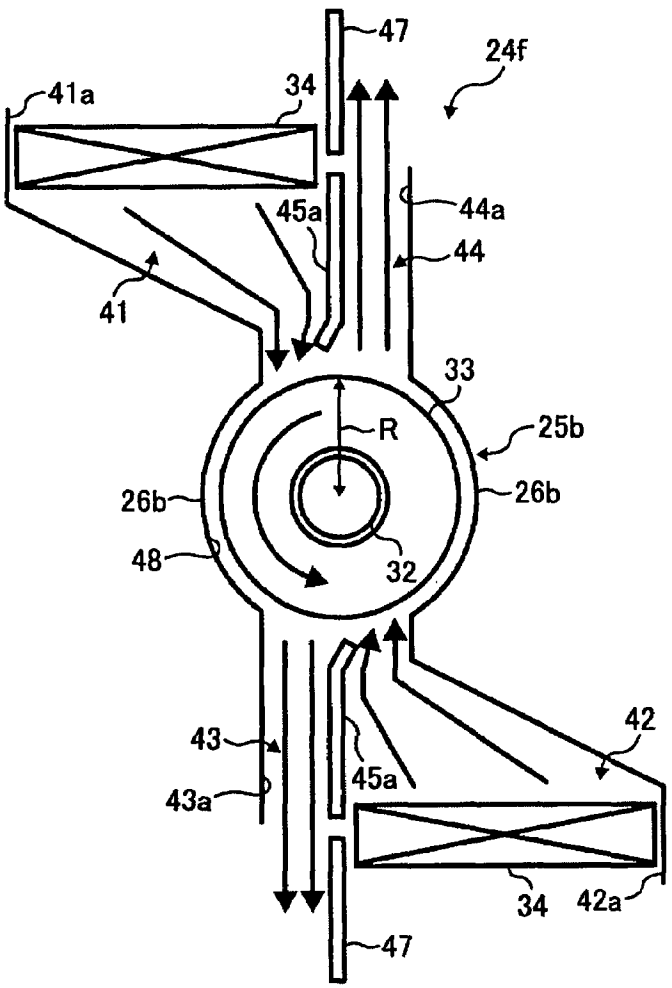
FIG. 24 is a cross-section view of a cooling duct having large-diameter air supply fans according to another embodiment of the present invention.

Referring now to FIG. 24, a cooling mechanism 24*f* according to another embodiment of the present invention is explained. The cooling mechanism 24*f* is, as illustrated in FIG. 24, similar to the cooling mechanism 24*e* of FIG. 23, except for a shape of the duct. That is, the duct 25*a* and the first duct plates 26*a* are replaced with a duct 25*b* and first duct plates 26*b*, respectively. In addition, the air exhaust fans 36 are eliminated.

As illustrated in FIG. 24, the duct 25*b* has a unique shape formed by the first duct plates 26*b*. More specifically, the air supply path 41 (and 42) has a smooth narrowing width from the air inlet 41*a* (and 42*a*) to an exit followed by a case portion 48 of the radiating fin 33. That is, the air inlet 41*a* (and 42*a*) has an inlet width in which the air supply fan 34 is completely encased therein and an exit width is smaller than a half of the radius R of the radiating fin 33. The air exhaust path 43 (and 44) has a continuous width smaller than half the radius R of the radiating fin 33.

Figure 2:
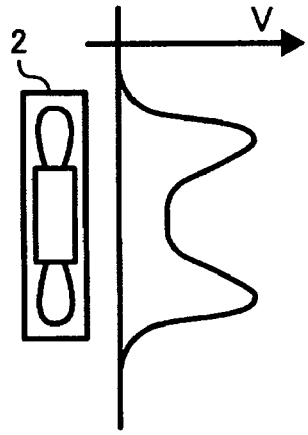
FIG. 2 PRIOR ART
FIG. 2 is an illustration for explaining a profile of an air flow speed observed in the cooling duct of the recording-sheet cooling system of the background image forming apparatus.

As explained earlier with reference to FIG. 2, the flowing air produced by the air supply fan generally has an uneven profile of flowing air speed. That is, the speed at circumferential outer regions of the air supply fan is relatively strong as it forms twin peaks in the profile, but is distinguishably weak at inner regions. If such an unevenly-profiled air is caused to impinge on the radiating fin 33, portions of the radiating fin 33 correspond to the inner regions of the air supply fan may not be supplied with a sufficient amount of cool air.

This uneven profile of the flowing air speed can be flattened by the structural arrangement of the cooling mechanism 24*f*. That is, causing the unevenly-profiled air to flow through the air supply path 41 having the smooth narrowing width can change the profile of the flowing air into a substantially-even profile at the exit of the air supply path 41.

Thus, the cooling mechanism 24*f* can improve the cooling effect.

Figure 25:
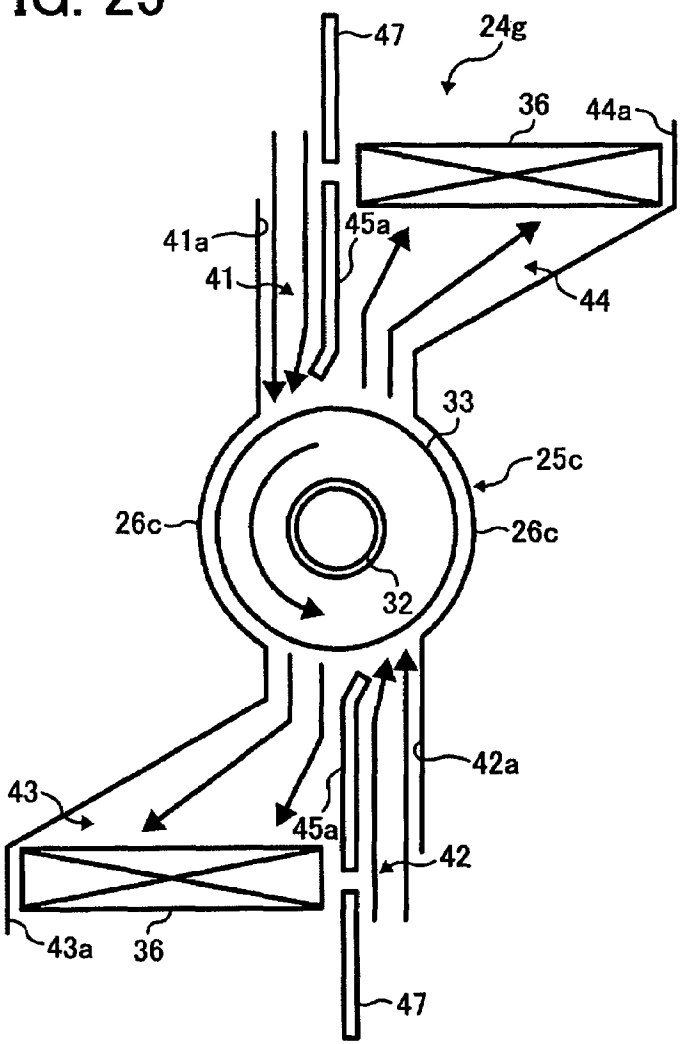
FIG. 25 is a cross-section view of a cooling duct having large-diameter air exhaust fans according to another embodiment of the present invention.

Referring now to FIG. 25, a cooling mechanism 24*g* according to another embodiment of the present invention is explained. The cooling mechanism 24*g* is, as illustrated in FIG. 25, similar to the cooling mechanism 24*e* of FIG. 23, except for a shape of the duct. That is, the duct 25*b* and the first duct plates 26*b* are replaced with a duct 25*c* and first duct plates 26*c*, respectively. In addition, the air supply fans 34 are eliminated.

As illustrated in FIG. 25, the duct 25*c* has a unique shape formed by the first duct plates 26*c*. More specifically, the air exhaust path 43 (and 44) has a smooth narrowing width from an entrance following the radiating fin 33 to the air outlet 43*a* (and 44*a*). The air outlet 43*a* (and 44*a*) has an outlet width in which the air exhaust fan 36 is completely encased therein and a width of the entrance is smaller than a half of the radius R of the radiating fin 33. The air supply path 41 (and 42) has a continuous width smaller than half the radius R of the radiating fin 33.

In the thus-structured duct 25*c*, the flowing air is intensively collected and is narrowed by the entrance of the air exhaust path 43 (and 44) after having been in contact with the radiating fin 33. Therefore, the radiating fin 33 may effectively be cooled down.

Figure 26:
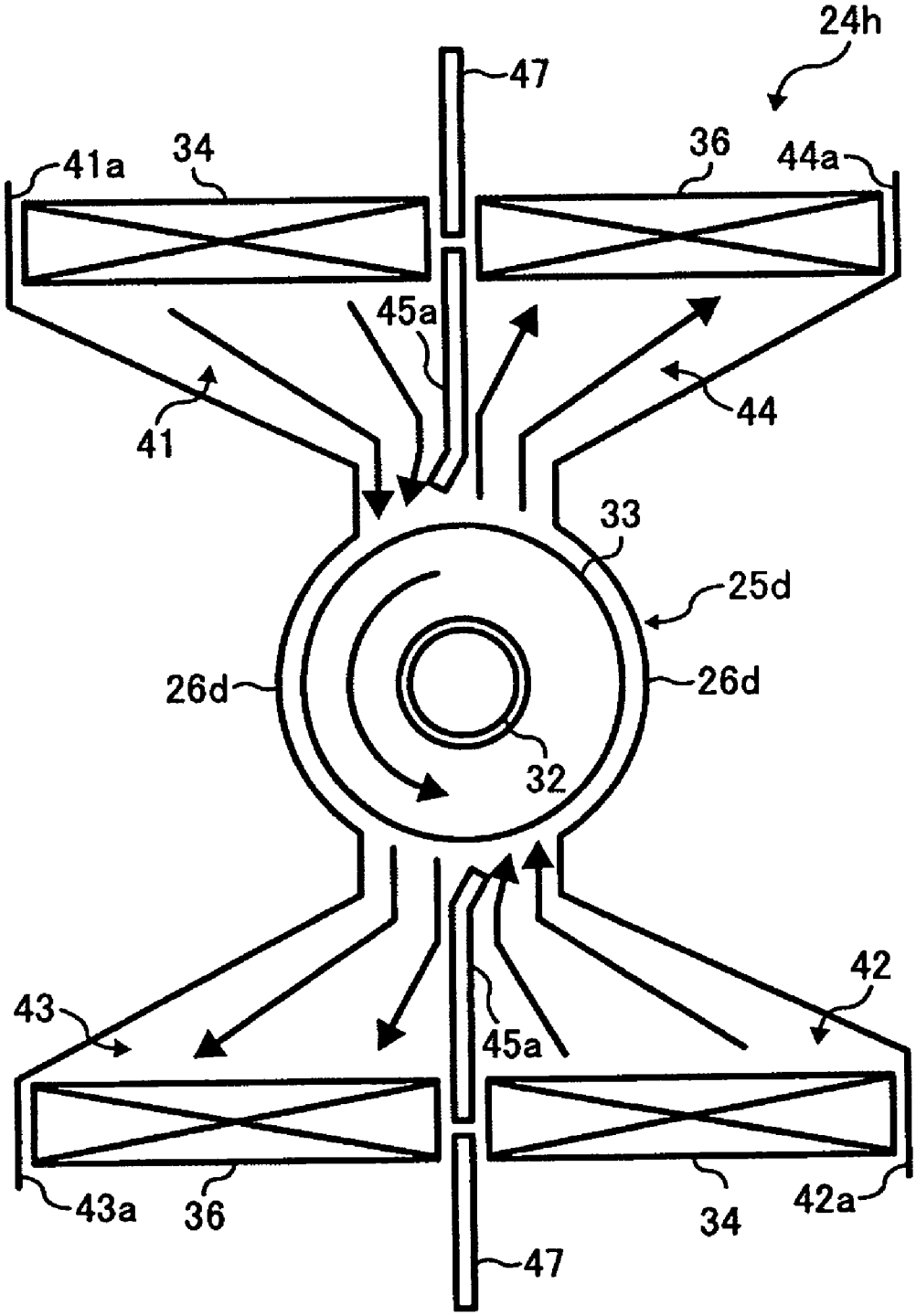
FIG. 26 is a cross-section view of a cooling duct having large-diameter air supply fans and large-diameter air exhaust fans according to another embodiment of the present invention.

FIG. 26 illustrates a cooling mechanism 24*h* according to another embodiment of the present invention. The cooling mechanism 24*h* of FIG. 26 combines the cooling mechanisms 24*f* and 24*g* into one mechanism using two pairs of the air supply fan 34 and the air exhaust fan 36. This structure can produce a combined effect of the cooling mechanisms 24*f* and 24*g*.

Figure 27:
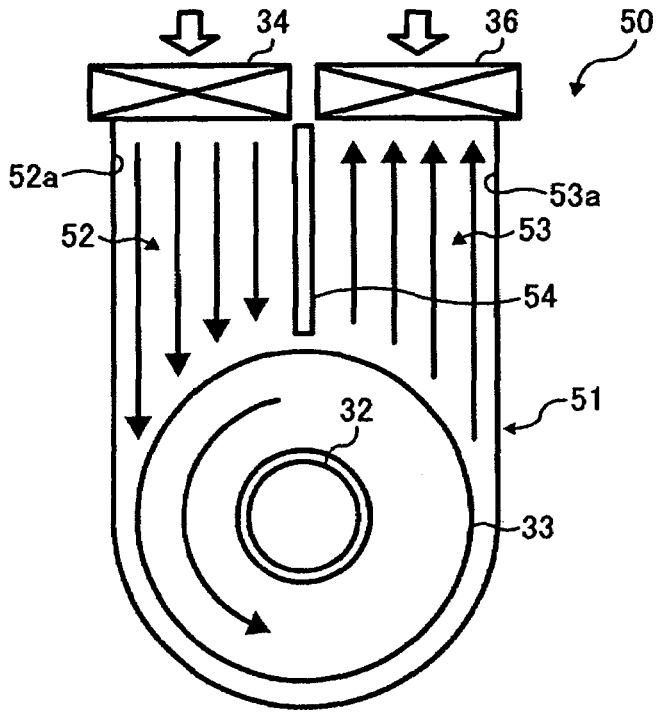
FIGS. 27 and 28 are cross-section views of U-like-shaped cooling ducts according to different embodiment of the present invention.
Figure 28:
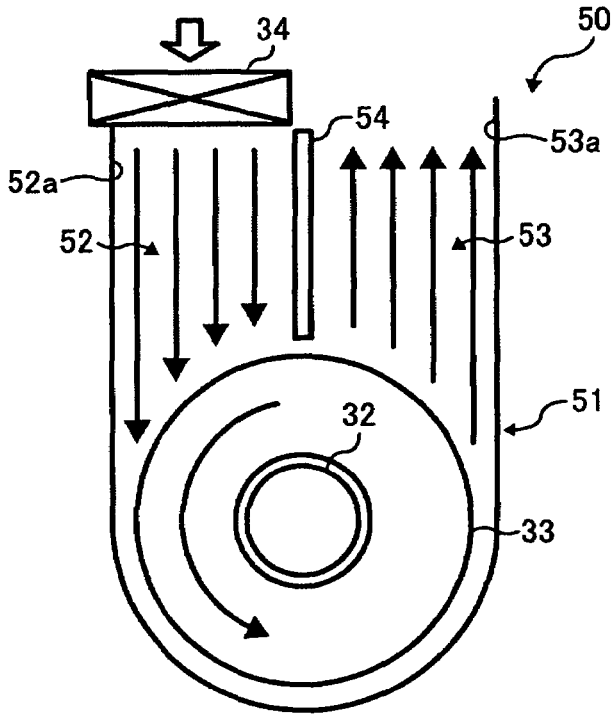

Referring to FIGS. 27 and 28, a cooling mechanism 50 according to another embodiment of the present invention is explained. As illustrated in FIG. 27, the cooling mechanism 50 includes the heat pipe 32, the radiating fin 33, the air supply fan 34, and the air exhaust fan 36, which are explained above. The cooling mechanism 50 further includes a duct 51 and a partition plate 54. The duct 51 internally forms an air supply path 52 and an air exhaust path 53 with the partition plate 54 disposed therebetween. That is, the air supply path 52 and the air exhaust path 53 are next to each other via the partition plate 54. The air supply path 52 has an opening which is referred to as an air inlet 52*a* and another opening which is referred to as an air outlet 53*a*.

With this structure, the air supply fan 34 takes in fresh air and supplies it into the air supply path 52 via the air inlet 52*a*. The flowing air thus taken inside the duct 51 impinges on the radiating fin 33 and turns along with the rotation of the radiating fin 33, thereby cooling the radiating fin 33. As illustrated in FIG. 27, the radiating fin 33 rotates in a direction same as a direction of the flowing air. The flowing air makes a half turn along the radiating fin 33 and runs into the air exhaust path 53 which leads the flowing air via the air inlet 53*a* to the air exhaust fan 36 to eject the flowing air. In this way, the cooling mechanism 50 effectively performs the cooling of the radiating fin 33 and the connected heat pipe 32 so as to cool down the heated recording sheet ejected from the toner fixing unit 17.

This structure forms the adjacent input and output paths, that is, the air supply path 52 and the air exhaust path 53, and advantageously uses a half side of the radiating fin 33 as an input side and another half side of the radiating fin 33 as an output side.

Thus, the cooling mechanism 50 can effectively cool down the heat pipe 32. As a result, the heated recording sheet can efficiently be cooled off.

In addition, since the cooling efficiency of the heat pipe 32 can be reduced, it is possible to use an air supply fan and an air exhaust fan having relatively low ratings. This leads to the energy saving and the noise reduction.

As an alternative, it may be possible to provide the duct 51 with the air supply fan 34 at the air inlet 52*a* but not to provide the air exhaust fan 36 at the air outlet 53*a*, as illustrated in FIG. 28. Although it is not shown, it may also be possible to provide the duct 51 with the air exhaust fan 36 at the air outlet 53*s* but not to provide the air supply fan 34 at the air inlet 52*a*. According to Applicant experimental results, even these alternative examples using a single fan successively reduced a heat resistance by 41% in comparison with a comparative example which has no air supply fan nor air exhaust fan.

Figure 29:
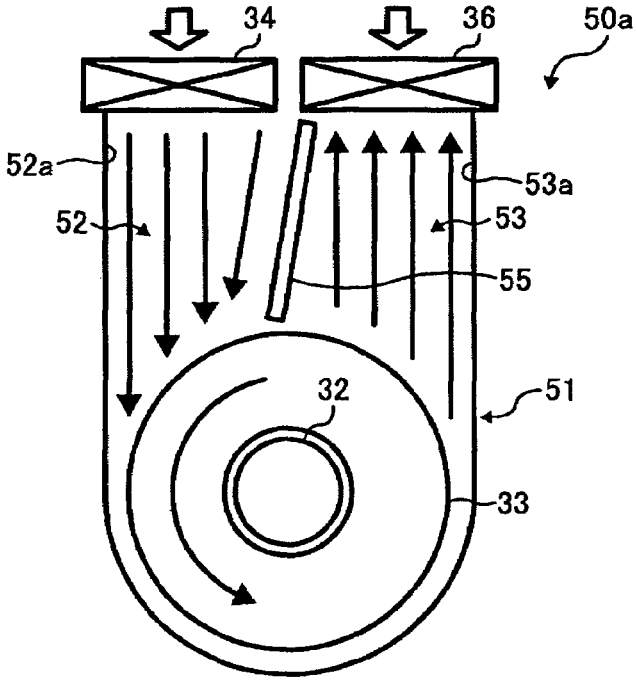
FIG. 29 is a cross-section view of a U-like-shaped cooling duct having slant partition plates according to another embodiment of the present invention.
Figure 30:
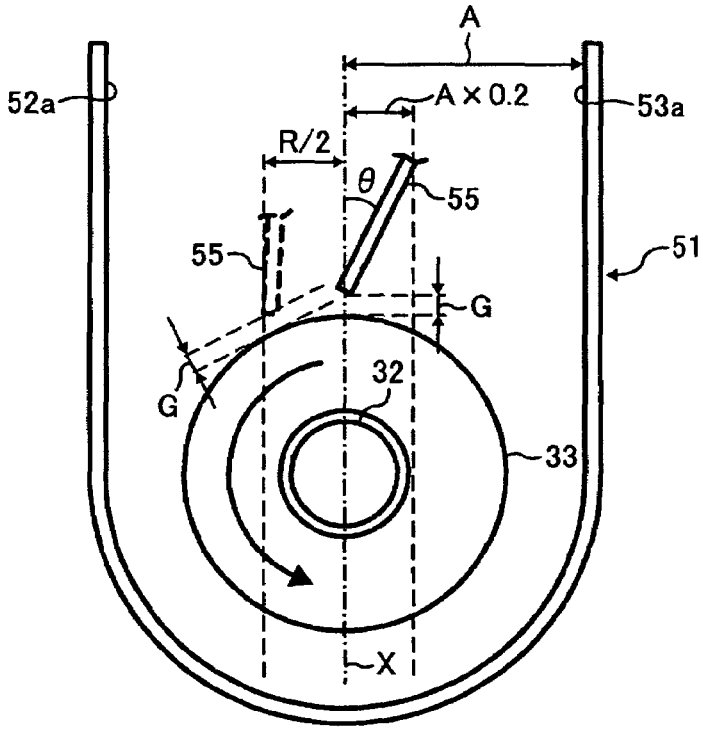
FIG. 30 is an illustration for explaining a physical relationship between the slant partition plates and the radiating fin of the cooling duct of FIG. 29.

Referring to FIGS. 29 and 30, a cooling mechanism 50*a* according to another embodiment of the present invention is explained. The cooling mechanism 50*a* is, as illustrated in FIG. 29, similar to the cooling mechanism 50 of FIG. 27, except for a partition plate 55 which is tilted in a direction opposite to the rotation direction of the radiating fin 33. Thus, the air supply path 52 is provided with a slope by the partition plate 55 so that the air flowing in the air supply path 52 is gradually narrowed and accelerated as coming closer to the radiating fin 33. In addition, with this slope of the partition plate 55, the air flowing along the slope is directed to the radiating fin 33 and is caused to collide with the radiating fin 33 with an angle smaller than a right angle. This effect avoids an unexpected air flow into the gap G of FIG. 30, resulting in a further improvement of the cooling effect.

When the tilt angle of the partition plate 55 is too small, the improvement may not be sufficient. But, when the tilt angle of the partition plate 55 is too large, the flowing air may not enter into space between the fins of the radiating fin 33, resulting in an inefficiency of cooling.

Therefore, the partition plate 55 needs to be arranged at a suitable position. The factors to determine the suitable position of the partition 55 are similar to those explained with reference to FIG. 16. Specifically, the factors include the gap G, the angle θ, and the positional range for the partition plate 55 to be placed in a width direction perpendicular to the direction of the air flow.

As for the positional range, an edge portion of the partition plate 55 is positioned within a range of half the radius R of the radiating fin 33 from the center axis X of the radiating fin 33, as illustrated in FIG. 30. The gap G is preferably set in a range of from approximately 3 mm to approximately 5 mm. The tilt angle θ of the partition plate 55 is preferably set to approximately 15 degrees at maximum when the edge portion is positioned approximately at the center axis X of the radiating fin 33. But, the partition plate 55 is preferably set to a position approximately parallel to the center axis X of the radiating fin 33, that is, the tile angle θ is 0, when the edge portion is positioned approximately at an end of half the radius R of the radiating fin 33.

In this way, the cooling mechanism 50*a* of the copying machine 1 has a structure in which the partition plate 55 is tilted in a direction opposite to the rotation direction of the radiating fin 33 so that the flowing air in the air supply path 52 is narrowed as it comes closer to the radiating fin 33. As a result, the air flow speed may be accelerated and the air flow may not be disturbed by an air turbulence at a top edge of the partition plate 55. Therefore, the cooling effect of the heat pipe 32 may be enhanced, thereby efficiently cooling down the heated recording sheet.

In addition, since the cooling efficiency of the heat pipe 32 can be reduced, it is possible to use an air supply fan and an air exhaust fan having relatively low ratings. This leads to efficiently achieving the energy saving and the noise reduction.

Figure 31:
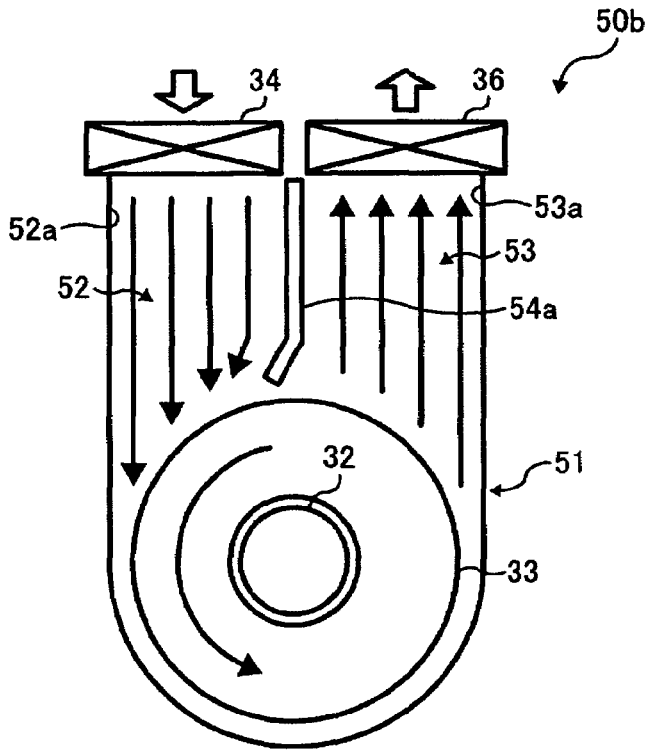
FIGS. 31-37 are cross-section views of U-like-shaped cooling ducts according to different embodiment of the present invention.

Referring now to FIG. 31, a cooling mechanism 50*b* according to another embodiment of the present invention is explained. The cooling mechanism 50*b* is, as illustrated in FIG. 31, similar to the cooling mechanism 50*a* of FIG. 29, except for a partition plate 54*a* which includes a main portion and a leading portion. The leading portion faces the radiating fin 33, has a length shorter than the main portion, and is bent relative to the main portion. The partition plate 54*a* is disposed inside the duct 51 in a way such that the main portion is parallel to directions of the air flows and the leading portion is bent in a direction opposite to the rotation direction of the radiating fin 33.

If the straight partition plate is merely tilted, as illustrated in FIG. 29, the narrowing air exhaust path may interfere a smooth air exhaustion and, in addition, it may induce a backward air flow from the air inlet 52*a*. This results in a degradation of the cooling efficiency.

As described above, the length of the leading portion is shorter than the main portion. However, if the leading portion is too short, it cannot produce a sufficient cooling effect. On the other hand, if the leading portion is too long, it may cause an interference with the air flow in the air exhaust path. In this example, the length of the leading portion is preferably within a range of from approximately 20 mm to a value which corresponds to a reduction rate of the width of the air outlet 53*a* smaller than 20%.

Thus, this arrangement can efficiently produce a cooling effect similar to or superior to the examples illustrated in FIGS. 27 and 29. In this example, the basic positional relationships between the partition plate 54*a* and the radiating fin 33 are same as those illustrated in FIG. 30. That is, the basic positional relationship includes the gap between the leading edge of the partition plate 54*a* and the radiating fin 33. It also includes the basic and allowable position of the partition plate 54*a* relative to the center axis X of the radiating fin 33.

Figure 32:
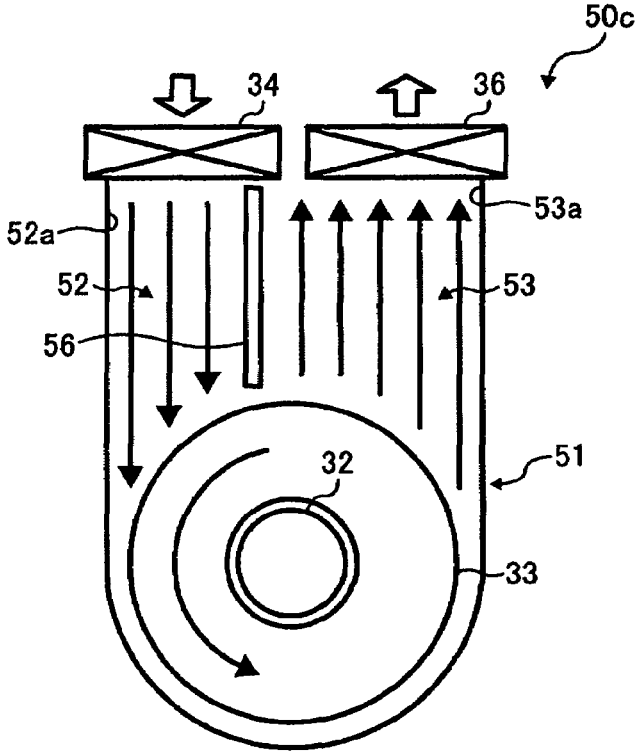

Referring now to FIG. 32, a cooling mechanism 50*c* according to another embodiment of the present invention is explained. The cooling mechanism 50*c* is, as illustrated in FIG. 32, similar to the cooling mechanism 50*b* of FIG. 31, except for a partition plate 56 which is formed at a position making the air supply path 52 narrower and the air exhaust path 53 wider.

With this structure, the air supply path 41 is narrowed and therefore the speed of the air flow may be accelerated in a manner similar to the example of FIG. 20. At the same time, the air exhaust path 52 is widened so as not to interfere the air flow in the air exhaust path 53. In addition, this arrangement avoids an occurrence of an air turbulence at the leading edge of the partition plate 54*a*.

Thus, this arrangement can efficiently produce a cooling effect in a manner similar to or superior to the examples of FIGS. 27, 29, and 31.

In each one of the cooling mechanisms 50*a*, 50*b*, and 50*c*, it may be possible to provide the duct 51 with the air supply fan 34 at the air inlet 52*a* but not to provide the air exhaust fan 36 at the air outlet 53*a*, as illustrated in FIG. 28. Although it is not shown, it may also be possible to provide the duct 51 with the air exhaust fan 36 at the air outlet 53*s* but not to provide the air supply fan 34 at the air inlet 52*a*.

Figure 33:
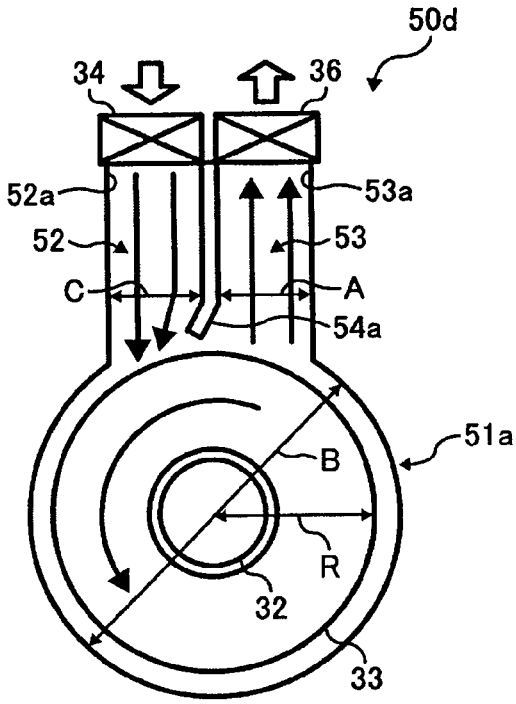

Referring now to FIG. 33, a cooling mechanism 50*d* according to another embodiment of the present invention is explained. The cooling mechanism 50*d* is, as illustrated in FIG. 33, similar to the cooling mechanism 50*c* of FIG. 32, except for a duct 51*a*. As illustrated in FIG. 33, the duct 51*a* forms a specific shape particularly around the radiating fin 33. The definitions of the letters A-C in FIG. 22 also apply to FIG. 33. That is, the letter A defines the width of the main portion of the air exhaust path 53, the letter B defines an internal diameter of the duct 51 around the radiating fin 33, and the letter C defines the width of main portion of the air supply path 52. The specific shape of the duct 51*a* satisfies relationships B/2>A and B/2>C.

With this arrangement, the air taken in through the air inlet 52*a* is primarily narrowed by the width C of the air supply path 41 which is smaller than half the radius R of the radiating fin 33. The flowing air is then further narrowed into an air jet by the leading portion of the partition plate 54*a*. When the flowing air in the air supply path 52 reaches the radiating fin 33, the flowing air enters space of the radiating fin 33 which is a wider area having at least the width of radius R of the radiating fin 33. The air further flows halfway around the radiating fin 33. After flowing halfway around the radiating fin 33, the flowing air enters the air exhaust path 53 having the width A and is therefore narrowed into an air flow with the width A, resulting in an accelerated speed of the air flow. The narrowed flowing air is then ejected outside via the air outlet 53*a* by the air exhaust fan 36.

The flowing air can easily enters between the gaps of fins of the radiating fin 33 by, as described above, being narrowed into an air jet in the air supply path 52 and being blown to the fins of the radiating fin 33. To make this more effective, the width C of the air supply path 52 needs to be smaller than half the radius R of the radiating fin 33.

With this arrangement, it becomes possible to intensively blow cooled air on the radiating fin 33 so as to effectively cool down the heat pipe 32. As a result, the heated recording sheet can efficiently be cooled off.

In addition, since the cooling efficiency of the heat pipe 32 can be reduced, it is possible to use an air supply fan and an air exhaust fan having relatively low ratings. This leads to efficiently achieving the energy saving and the noise reduction.

Since the cooling mechanism 50*d* applies the specific shape of the duct 51*a* satisfying relationships B/2>A and B/2>C, it can effectively be made in a relatively compact size.

Figure 34:
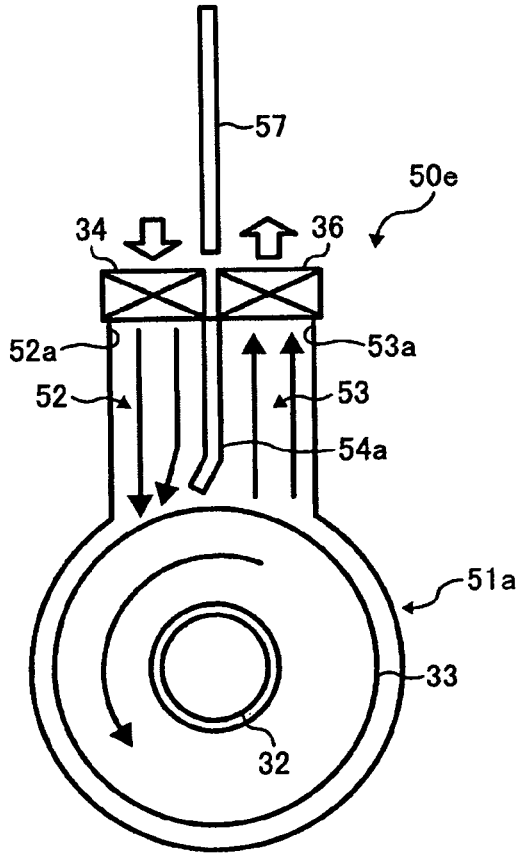

Referring now to FIG. 34, a cooling mechanism 50*e* according to another embodiment of the present invention is explained. The cooling mechanism 50*e* is, as illustrated in FIG. 34, similar to the cooling mechanism 50*d* of FIG. 33, except for an external partition plate 57. The external partition plate 57 is a partition of the duct 51*a* disposed at a position on an extension of the main portion of the partition plate 54*a* and outside the air supply fan 34 and the air exhaust fan 36, as illustrated in FIG. 34.

With this structure having the external partition plates 57, it becomes possible to prevent a mixture of fresh air at the air supply fans 34 with the heated air ejected from the air exhaust fans 36. Thus, the cooling mechanism 50*e* can effectively cool down the heat pipe 32. As a result, the heated recording sheet can efficiently be cooled off.

Figure 35:
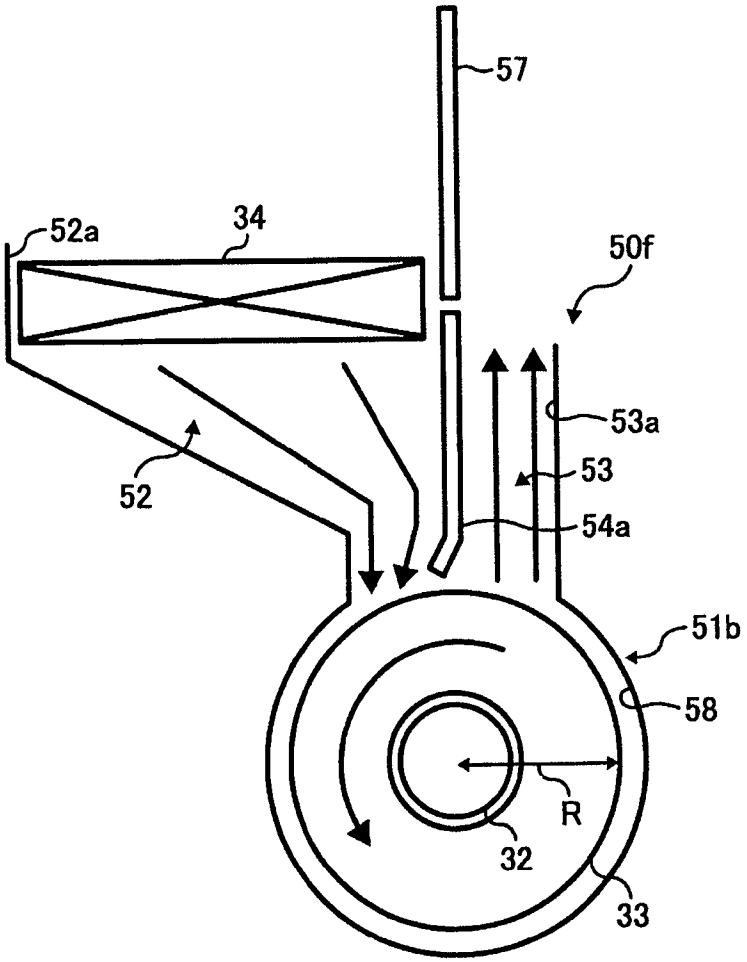

Referring now to FIG. 35, a cooling mechanism 50*f* according to another embodiment of the present invention is explained. The cooling mechanism 50*f* is, as illustrated in FIG. 35, similar to the cooling mechanism 50*e* of FIG. 34, except for a shape of the duct. That is, the duct 51*a* is replaced with a duct 51*b*. In addition, the air exhaust fan 36 is eliminated.

As illustrated in FIG. 35, the duct 51*b* has a unique shape. More specifically, the air supply path 52 has a smooth narrowing width from the air inlet 52*a* to an exit followed by a case portion 58 encasing the radiating fin 33. That is, the air inlet 52*a* has an inlet width in which the air supply fan 34 is completely encased therein and an exit width is smaller than a half of the radius R of the radiating fin 33. The air exhaust path 53 has a continuous width smaller than half the radius R of the radiating fin 33.

As explained earlier with reference to FIG. 2, the flowing air produced by the air supply fan generally has an uneven profile of flowing air speed. That is, the speed at circumferential outer regions of the air supply fan is relatively strong as it forms twin peaks in the profile, but is distinguishably weak at inner regions. If such an unevenly-profiled air is caused to impinge on the radiating fin 33, portions of the radiating fin 33 correspond to the inner regions of the air supply fan may not be supplied with a sufficient amount of cool air.

This uneven profile of the flowing air speed can be flattened by the structural arrangement of the cooling mechanism 50*f*. That is, causing the unevenly-profiled air to flow through the air supply path 52 having the smooth narrowing width can change the profile of the flowing air into a substantially-even profile at the exit of the air supply path 52.

Thus, the cooling mechanism 24*f* can improve the cooling effect.

Figure 36:
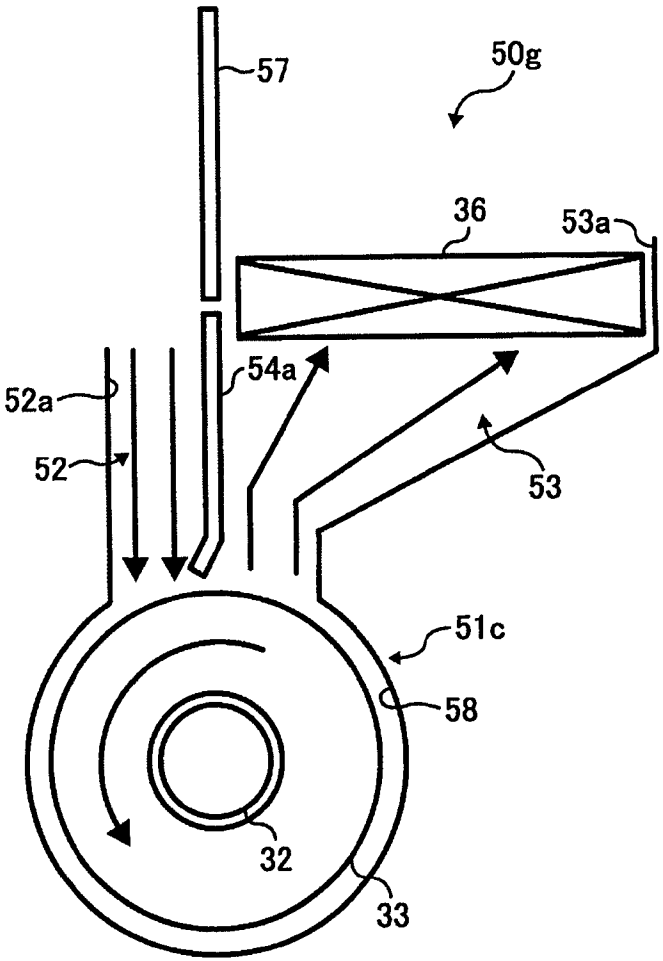

Referring now to FIG. 36, a cooling mechanism 50*g* according to another embodiment of the present invention is explained. The cooling mechanism 50*g* is, as illustrated in FIG. 36, similar to the cooling mechanism 50*e* of FIG. 35, except for a shape of the duct. That is, the duct 51*b* is replaced with a duct 51*c*. In addition, the air supply fan 34 is eliminated.

As illustrated in FIG. 36, the duct 51*c* has a unique shape. More specifically, the air exhaust path 53 has a smooth narrowing width from an entrance following the radiating fin 33 to the air outlet 53*a*. The air outlet 53*a* has an outlet width in which the air exhaust fan 36 is completely encased therein and a width of the entrance is smaller than a half of the radius R of the radiating fin 33. The air supply path 52 has a continuous width smaller than half the radius R of the radiating fin 33.

In the thus-structured duct 51*c*, the flowing air is intensively collected and is narrowed by the entrance of the air exhaust path 53 after having been in contact with the radiating fin 33. Therefore, the radiating fin 33 may effectively be cooled down.

Figure 37:
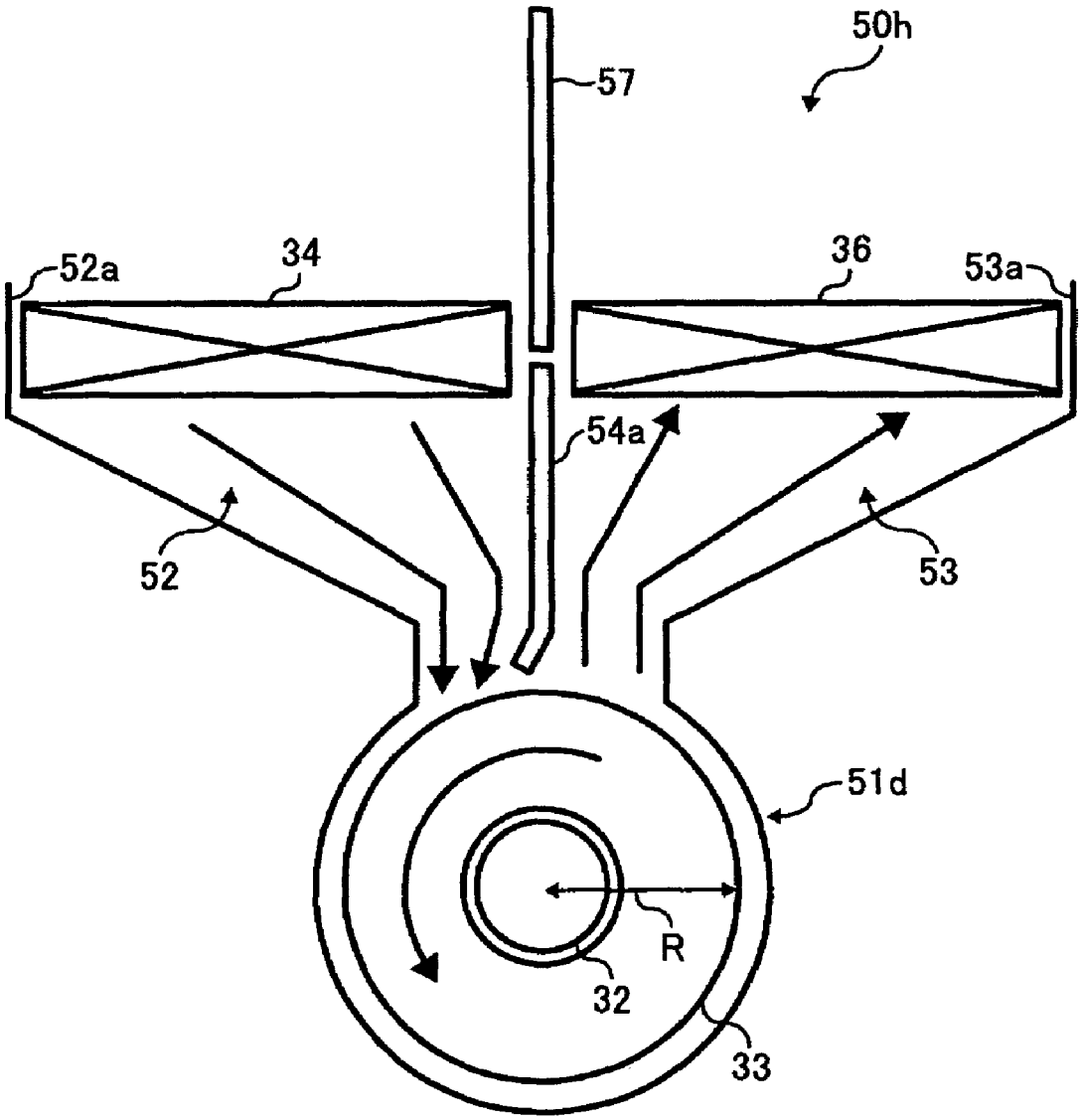

FIG. 37 illustrates a cooling mechanism 50*h* according to another embodiment of the present invention. The cooling mechanism 50*h* of FIG. 37 combines the cooling mechanisms 50*f* and 50*g* into one mechanism using a pair of the air supply fan 34 and the air exhaust fan 36. This structure can produce a combined effect of the cooling mechanisms 50*f* and 50*g*.

Figure 38:
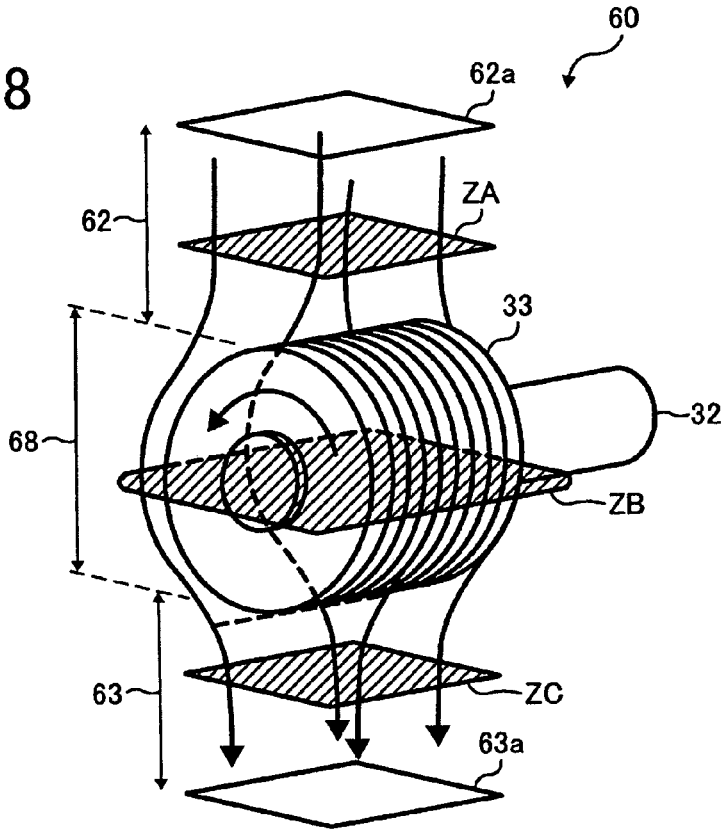
FIG. 38 is a perspective view of a cooling duct according to another embodiment of the present invention.

Referring now to FIG. 38, a cooling mechanism 60 according to another embodiment of the present invention is explained. As illustrated in FIG. 38, the cooling mechanism 60 includes the heat pipe 32, the radiating fin 33, and a duct 61 which forms an air supply path 62 and an air exhaust path 63. The air supply path 62 has an entrance opening referred to as an air inlet 62*a*, and the air exhaust path 63 has an exit opening referred to an air outlet 63*a*.

The duct 61 is formed of the pair of the first duct plates 26 and the second duct plates 27 used in the cooling mechanism 24 illustrated in FIG. 6 although they are not illustrated in FIG. 38. Also, the air supply fan 34 and the air exhaust fan 36 are not illustrated in FIG. 38, although they can be used in the cooling mechanism 60.

The shape of the duct 61 satisfies a relationship of ZA<ZB or ZC<ZB, in which ZA is a cross-section area of the air supply path 62, ZB is a cross-section area of an inner diameter of a casing portion 68 of the duct 61 around the radiating fin 33, and ZC is a cross-section area of the air exhaust path 63.

In the duct 61, a fresh air is taken in through the air inlet 62*a* and is narrowed while flowing forward through the air supply path 62 having the cross-section area ZC smaller than the cross-section area ZB. Then, the flowing air reaches and impinges on the rotating heated radiating fin 33, and is extended into the casing portion 68 as it is absorbing the heat from the radiating fin 33. After a half turn around the rotating radiating fin 33, the flowing air having the absorbed heat enters the air exhaust path 63 in which the flowing air is narrowed once again through the cross-section area ZC. After that, the flowing air with heat is ejected outside via the air outlet 63*a*.

Thus, the fresh flowing air can intensively blow the fresh jet air on the radiating fin 33 so that the heat pipe 32 can effectively be cooled. Thereby, the recording sheet can effectively be cooled.

Since the cooling efficiency of the heat pipe 32 can be reduced, it is possible to use an air supply fan having a relatively low rating. This leads to effects of an energy saving as well as a noise reduction.

Furthermore, since the duct 61 satisfies a relationship of ZA<ZB or ZC<ZB, the cooling mechanism 60 can be made in a relatively compact size.

Figure 39:
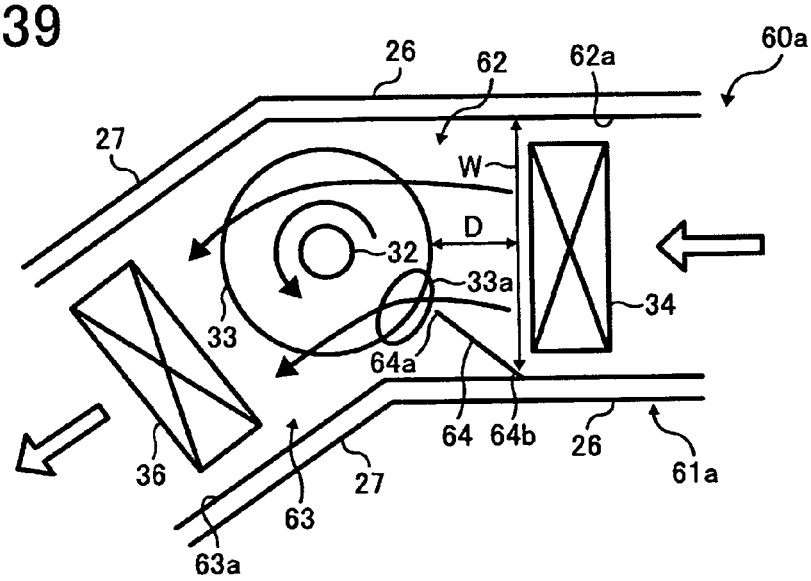
FIGS. 39-43 are cross-section views of cooling ducts according to different embodiments of the present invention.

Referring now to FIG. 39, a cooling mechanism 60*a* according to another embodiment of the present invention is explained. The cooling mechanism 60*a* of FIG. 39 is a variation model based on the cooling mechanism 60 of FIG. 38 and includes various common components of the cooling mechanism 60, except for a duct 61*a* and a guide plate 64. The duct 61*a* has a shape different from the duct 61. Specifically, the shape of the duct 61*a* is bent at a position around a middle part of the radiating fin 33, as illustrated in FIG. 39. The guide plate 64 includes first and second top portions 64*a* and 64*b*, and is disposed on an inner surface of the first duct plate 26 to face a side of the radiating fin 33 in which a rotation direction is opposite to the flow of air, as also illustrated in FIG. 39. More specifically, the first top portion 64*a* is positioned upstream from the radiating fin 33 and inside the air supply path 62, and the second top portion 64*b* is connected to the inner surface of the first duct plate 26 at a position next to the air supply fan 34.

The flow of air from the air inlet 62*a* to the air outlet 63*a* in the duct 61*a* is generally similar to those of the examples described above. In this example, the guide plate 64 narrows the cross-section area ZA so that a pressure of the flowing air is increased and the flowing speed of air is accelerated.

The guide plate 64 positioned upstream from the radiating fin 33 has an angle to the air flow such that the cross-section area ZA is gradually decreased in the direction from the air supply fan 34 to the radiating fin 33. Thus, the air flowing in the air supply path 62 is gradually narrowed and is accelerated with increasing pressure as it runs through the air supply path 62. Furthermore, the angle of the guide plate 64 is a specific angle to direct the first top portion 64*a* toward a circumferential surface of the radiating fin 33 so that the flowing air can intensively impinge on the radiating fin 33 at a specific circumferential surface area thereof. This arrangement is to prevent leakage of the air through a gap between the radiating fin 33 and the first and second duct plates 26 and 27 behind the guide plate 64.

As described above, an angle and a length of the guide plate 64 may be determined based mainly on a positional relationship between the air supply fan 34 and the radiating fin 33. The cooling mechanism 60*a* of FIG. 39 has the following various measurements. The air supply fan 34 and the radiating fin 33 has a distance D of 20 mm. The duct 61*a* has a width D of 95 mm. The radiating fin 33 has an outer diameter of 60 mm. The angle and the length of the guide plate 64 are 45 degrees and 25 mm, respectively.

According to experimental results conducted by Applicant, the cooling mechanism 60 marked a thermal resistance value of 0.22 K/W under the above-described forcible air cooling while a comparison example which was not provided with the guide plate 64 marked 0.30 K/W. That is, the cooling mechanism 60 reduces the thermal resistance at the forcible air cooling by approximately 27% in comparison with the above-mentioned comparison example.

Figure 40:
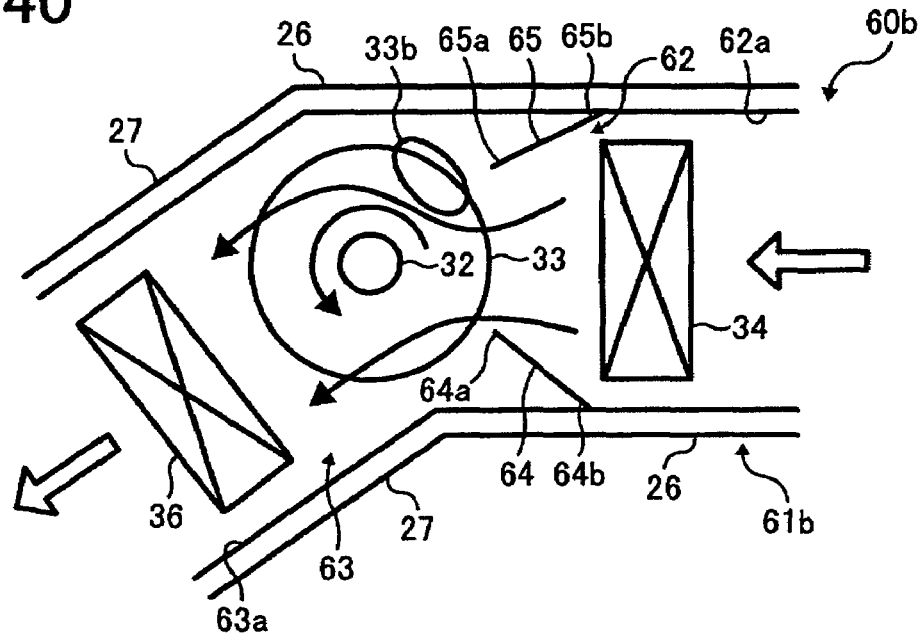

FIG. 40 illustrates a cooling mechanism 60*b* according to another embodiment of the present invention. The cooling mechanism 60*b* of FIG. 40 is similar to the cooling mechanism 60*a* of FIG. 39, except for a guide plate 65. The guide plate 65 includes first and second top portions 65*a* and 65*b*, and is disposed at a position correspondingly opposite to the guide plate 64 relative to the air supply fan 34. The first top portion 65*a* is directed to a circumferential surface of the radiating fin 33. Such a guide plate 65 is to prevent leakage of the flowing air through a gap between an inner surface of the duct 61*b* and the radiating fin 33 at a side of the radiating fin 33 in which the radiating fin 33 rotates in a forward direction relative to the flowing direction of air.

With this structure, the cooling mechanism 60*b* can produce a more intensive air jet in the air supply path 62 to make it impinge on the radiating fin 33, so that the heated radiating fin 33 can be cooled down in a more effective manner. The cooling mechanism 60*b* experimentally marked 0.20 K/W which is an approximately—33% reduction in comparison with the above-mentioned comparison example.

Figure 41:
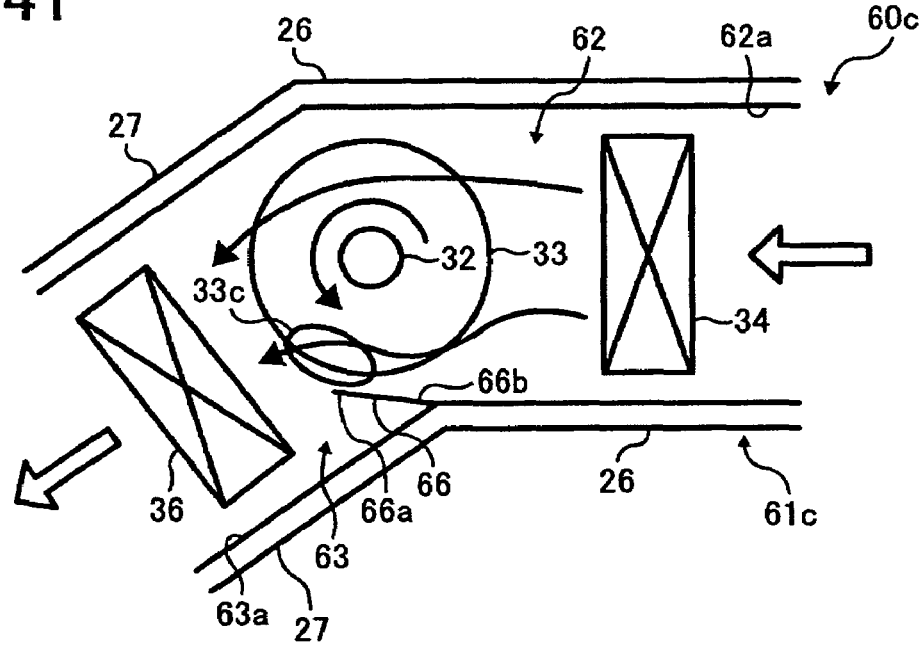

FIG. 41 illustrates a cooling mechanism 60*c* according to another embodiment of the present invention. The cooling mechanism 60*c* of FIG. 41 is similar to the cooling mechanism 60*a* of FIG. 39, except for a guide plate 66. More specifically, the guide plate 64 is eliminated and the guide plate 66 is added instead. The guide plate 66 includes first and second top portions 66*a* and 66*b*, and is disposed at a position next to a middle part of the radiating fin 33 where the first duct plate 26 is connected to the second duct plate 27. More specifically, the first top portion 66*a* locates downstream from the radiating fin 33 in the air flowing direction. At this location, the first top portion 66*a* faces a circumferential surface 33*c* of the radiating fin 33 where the rotation direction of the radiating fin 33 is backward to the air flowing direction.

With this arrangement, the air flowing through the gap between a backward-rotating-side of the radiating fin 33 and the duct 61*c* is caused to intensively impinge on the radiating fin 33, so that the flowing air effectively enters the gaps between the fins of the radiating fin 33. As a result, the cooling mechanism 60*c* can cool down the radiating fin 33 at a level of efficiency similar to the cooling mechanism 60*a* of FIG. 39.

Figure 42:
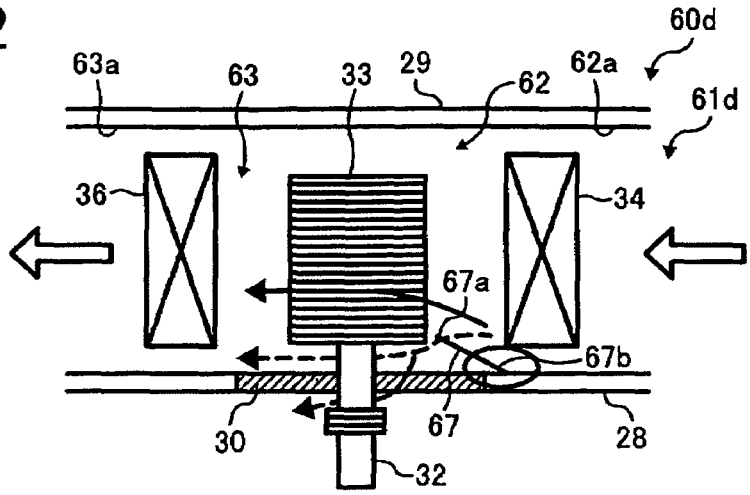

Referring now to FIG. 42, a cooling mechanism 60*d* according to another embodiment of the present invention is explained. The cooling mechanism 60*d* of FIG. 42 is similar to the cooling mechanism 60*c* of FIG. 41 and is viewed in a direction from top to bottom in FIG. 41 in a manner similar to the cooling mechanism 24 of FIG. 7. The cooling mechanism 60*d* of FIG. 42 has differences from the cooling mechanism 60*c* of FIG. 41. That is, the guide plate 66 is eliminated and instead a guide plate 67 is added. The guide plate 67 includes first and second top portions 67*a* and 67*b*, and is disposed upstream from the radiating fin 33 on a side close to the heat pipe 32.

More specifically, the guide plate 67 is provided such that the first top portion 67*a* is arranged next to an edge of the radiating fin 33 and the second top portion 67*b* is connected to an inner surface of the partition panel 28 at a position next to the air supply fan 34. In other words, the guide plate 67 gradually reduces the cross-section area ZA of the air supply in a direction from the air supply fan 34 to the radiating fin 33 so that the flowing air is gradually intensified and has an increasing pressure. As a result, the flowing air is caused to intensively impinge on the radiating fin 33.

The above-described structure can prevent leakage of the flowing air through passages indicated by ghost lines in FIG. 42, including a passage via the opening 30, and it can instead direct the flowing air toward the radiating fin 33 as indicated by a solid line in FIG. 42.

Thus, the cooling mechanism 60*c* can effectively cool down the radiating fin 33.

Figure 43:
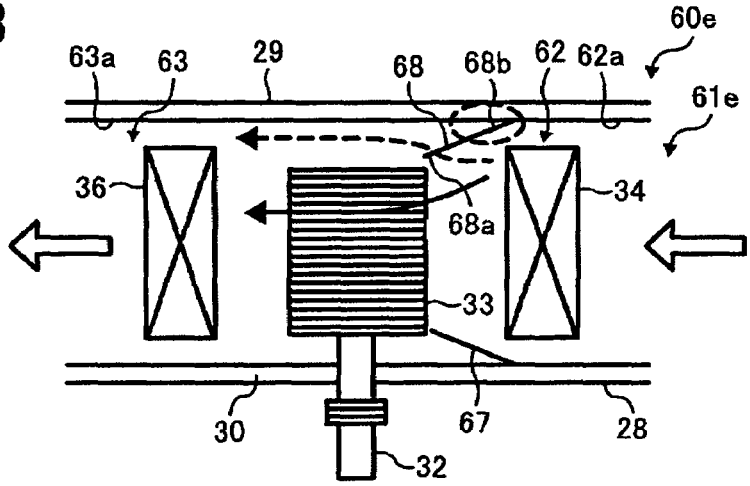

FIG. 43 illustrates a cooling mechanism 60*e* according to another embodiment of the present invention. The cooling mechanism 60*e* of FIG. 43 is similar to the cooling mechanism 60*d* of FIG. 42, except for a guide plate 68. The guide plate 68 includes first and second top portions 68*a* and 68*b*, and is disposed upstream from the radiating fin 33 on a side opposite to the guide plate 67. The guide plate 68 prevents leakage of the air through a passage indicated by a ghost line in FIG. 43. Thus, the cooling efficiency is improved.

Figure 44:
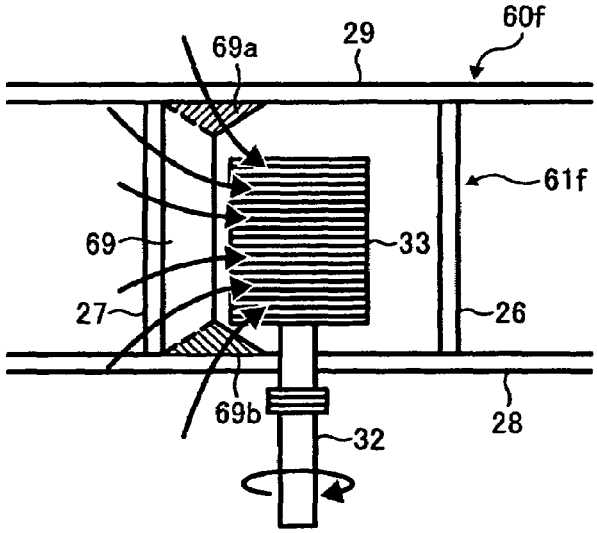
FIGS. 44 and 45 are illustrations of a cooling duct according to another embodiment of the present invention.
Figure 45:
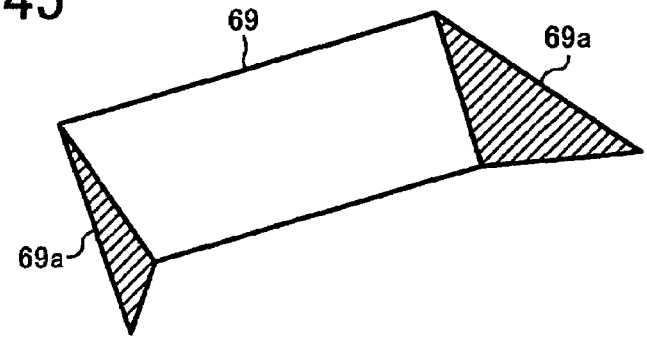

FIG. 44 illustrates a cooling mechanism 60*f* according to another embodiment of the present invention. The cooling mechanism 60*f* of FIG. 44 is viewed in a direction from the air supply fan 34 to the radiating fin 33. In FIG. 44, the duct 61*f* further includes a guide plate 69. The guide plate 69 narrows the air supply path 62 to intensify the flowing air. As illustrated in FIG. 45, the guide plate 69 is provided with overhangs 69*a* on both edges to be connected to the partition panel 28 and the rear cover 29. The overhangs 69*a* can further prevent leakage of the flowing air. Thus, the cooling mechanism 60*f* can effectively cool down the radiating fin 33.

Figure 46:
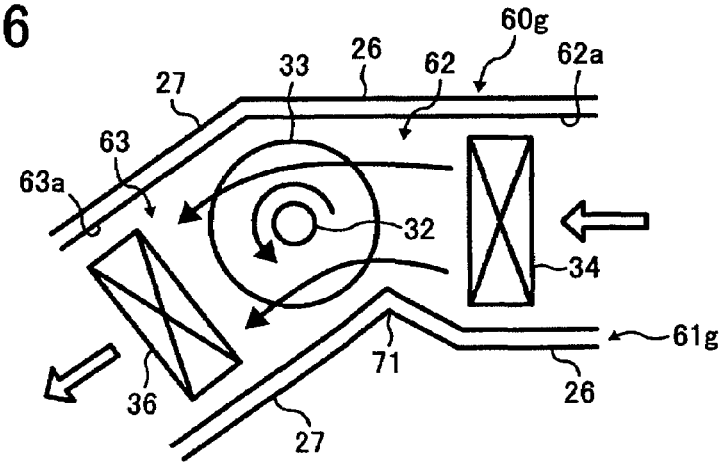
FIG. 46 is a cross-section view of a cooling duct having a demormed duct plate according to another embodiment of the present invention.

FIG. 46 illustrates a cooling mechanism 60*g* according to another embodiment of the present invention. The cooling mechanism 60*g* of FIG. 46 is similar to the cooling mechanism 60*a* of FIG. 39, except for a protuberance 71. More specifically, the protuberance 71 is provided in place of the guide plate 64, and is disposed downstream from the radiating fin 33 on a side of the first duct plate 26. The protuberance 71 is made by deforming the first duct plate 26, as illustrated in FIG. 46.

This arrangement produces an effect of air flow similar to that of the cooling mechanism 60*a* of FIG. 39. That is, the cooling mechanism 60*g* satisfies the relationship of A<B. Thus, the cooling mechanism 60*g* can effectively cool down the radiating fin 33.

Figure 47:
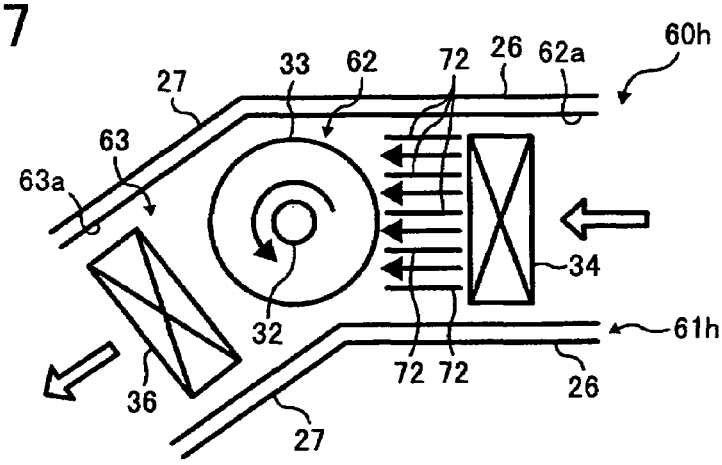
FIG. 47 is a cross-section view of a cooling duct having a plurality of parallely-arranged guide plates according to another embodiment of the present invention.
Figure 48:
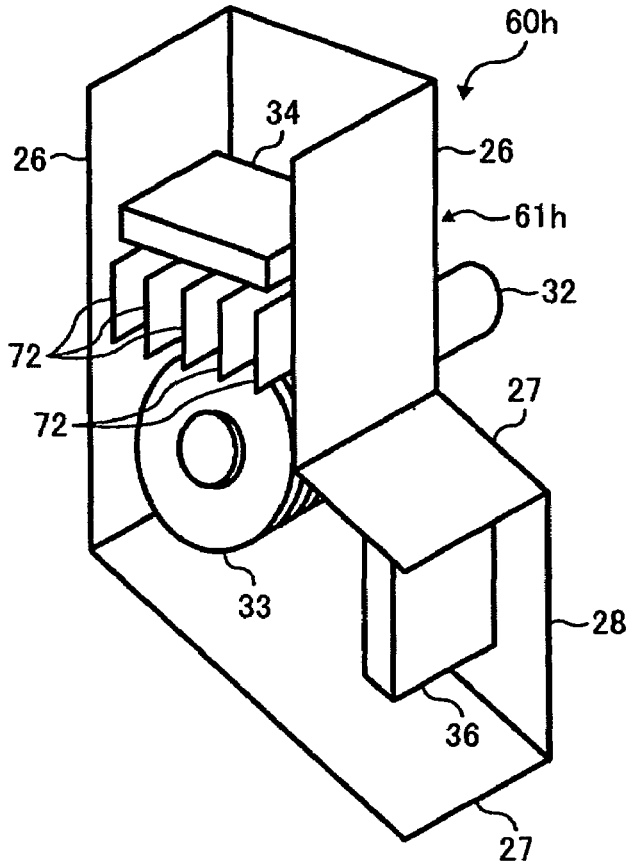
FIG. 48 is a perspective view of the cooling duct of FIG. 47.

Referring now to FIGS. 47 and 48, a cooling mechanism 60*h* according to another embodiment of the present invention is explained. The cooling mechanism 60*h* of FIGS. 47 and 48 is similar to the cooling mechanism 60*a* of FIG. 39, except for a plurality of guide plates 72. More specifically, the plurality of guide plates 72 are provided in place of the guide plate 64. The plurality of guide plates 72 are arranged with an approximately equal distance therebetween and in parallel to the flowing air, that is, perpendicular to the rotary axis of the radiating fin 33.

Although a number of guide plates 72 is determined based mainly on the width of the air supply path 62, four or more is preferable. In this example, the width of the air supply path 62 is 95 mm, and five of the guide plate 72 are applied.

With the above-described structure, the flowing air can straightly be directed toward the radiating fin 33 and caused to intensively impinge on the radiating fin 33, so that the radiating fin 33 can effectively be cooled down.

The plurality of guide plates 72 may be arranged such that a distance between adjacent two is greater at a side next to the air supply fan 34 than at another side next to the radiating fin 33. Thereby, the flowing air can be further intensified as coming closer to the radiating fin 33. As a result, the radiating fin 33 can be more effectively cooled down.

Figure 49:
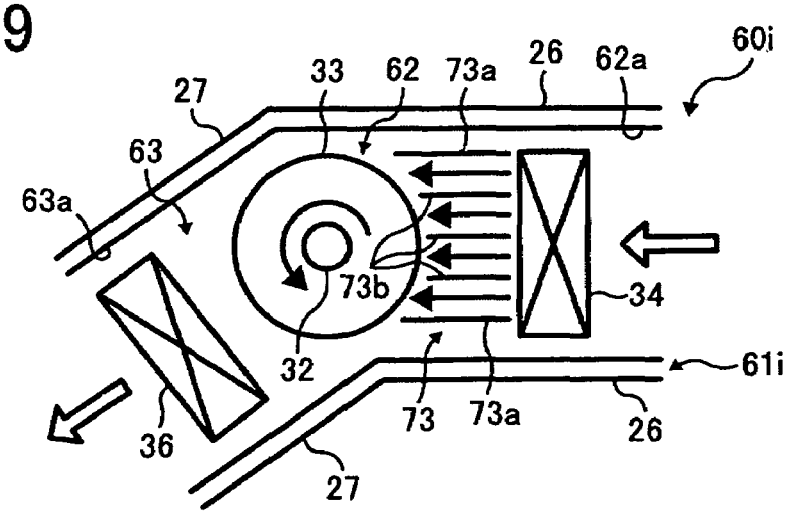
FIG. 49 is a cross-section view of a variation of the cooling duct of FIG. 48, according to another embodiment of the present invention.
Figure 50A:
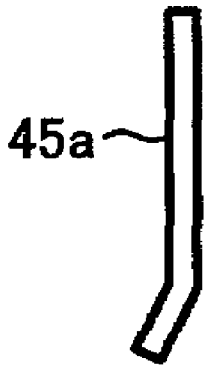
FIGS. 50A and 50B are illustrations for explaining a cooling duct having a slant partition plate according to another embodiment of the present invention.
Figure 50B:
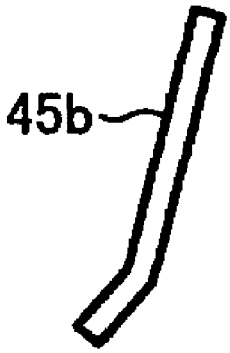

FIG. 49 illustrates a cooling mechanism 60*i* according to another embodiment of the present invention. The cooling mechanism 60*i* of FIG. 49 is similar to the cooling mechanism 60*h* of FIG. 47, except for a guide member 73. The guide member 73 includes five guide plates made of two long plates 73*a* and three short plates 73*b*. They are arranged in parallel to each other and to the flowing air, that is, perpendicular to the rotary axis of the radiating fin 33. Specifically, the two long plates 73*a* are arranged to sandwich the three short plates 73*b*, as illustrated in FIG. 49, so that the five guide plates have an approximately-equal and suitable distance to the circumferential surface of the radiating fin 33. As a result, the flowing air can intensively and evenly be caused to impinge on the radiating fin 33. Thus, the cooling mechanism 60*i* can more efficiently cool down the heat pipe 32 and consequently the recording sheet.

As an alternative to the partition plate 45*a* used in the above-described various examples such as the cooling mechanism 24 of FIG. 17, for example, a partition plate 45*b* may be used. Similar to the partition plate 45*a*, the partition plate 45*b* has the main portion and the leading portion. However, in the partition plate 45*b*, the main portion is inclined and the leading portion is more inclined so that the flowing air is rapidly intensified into a jet stream of air. This causes a jet air to impinge on the radiating fin 33 at an extremely high speed. Thus, the radiating fin 33 is effectively cooled down.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. JP2005-194013 filed on Jul. 1, 2005 and No. JP2006-147110 filed on May 26, 2006, in the Japan Patent Office, the entire contents of each of which are incorporated by reference herein.

What is claimed as new and desired to be secures by Letters Patent of the United States is:

1. An image forming apparatus, comprising:

an image forming mechanism configured to form a toner image on a recording sheet;

a toner fixing mechanism configured to heat the toner image on the recording sheet for fixing; and a cooling mechanism configured to cool down the heated recording sheet having the fixed toner image, the cooling mechanism including a duct including first and second air flow structures, each including an air inlet, an air supply path, an air exhaust path, and an air outlet, in this order to take in air through the air inlet and to eject the air through the air outlet via the air supply path and the air exhaust path in each of the first and second air flow structures, a radiating fin arranged in the duct between the air supply path and the air exhaust path of each of the first and second air flow structures, and having a plurality of fins each radially extending in parallel to a flow of air in the duct, and a heat pipe having one side connected to the radiating fin and another side arranged in a vicinity to an exit of the toner fixing mechanism, and configured to rotate to draw heat from the heated recording sheet having the fixed toner image, wherein the first and second air flow structures are arranged reversely side by side such that the air inlet, the air supply path, the air exhaust path, and the air outlet of the first air flow structure are adjacent to the air outlet, the air exhaust path, the air supply path, and the air inlet of the second air flow structure, respectively, and such that a flow of air through each of the first and second air flow structures is directed forwards relative to a rotation of the radiating fin and in same direction as the rotation of the radiating fin.

2. The image forming apparatus of claim 1, wherein the first air flow structure includes a first air supply fan and a first air exhaust fan, and the second air flow structure includes a second air supply fan and a second air exhaust fan.

3. The image forming apparatus of claim 1, wherein the duct further includes a first partition plate disposed at a position substantially at a center between the air supply path of the first air flow structure and the air exhaust path of the second air flow structure, and a second partition plate disposed at a position substantially center between the air exhaust path of the first air flow structure and the air supply path of the second air flow structure.

4. The image forming apparatus of claim 3, wherein each one of the first and second partition plates is arranged in parallel to the flow of air and includes a leading portion which faces the radiating fin and is bent into corresponding one of the air supply paths of the first and second air flow structures.

5. The image forming apparatus of claim 3, wherein each one of the first and second partition plates is disposed a position away from a plane, parallel to the flow of air in the air supply path and passing through a rotary axis of the radiating fin, toward the air supply path to make the air supply path narrower than the air exhaust path.

6. The image forming apparatus of claim 3, wherein the duct satisfies at least one of inequalities $B/2>A$ and $B/2>C$, wherein A is a width of the air supply paths of the first and second air flow structures, B is an internal diameter of the duct around the radiating fin, and C is a width of the air exhaust paths of the first and second air flow structures.

7. The image forming apparatus of claim 3, wherein each one of the air supply paths of the first and second air flow structures and each one of the air exhaust paths of the first and second air flow structures have a width smaller than half a radius of the radiating fin.

8. The image forming apparatus of claim 3, wherein the duct further includes a first external partition plate disposed at an external position outside and between the air inlet of the first air flow structure and the air outlet of the second air flow structure to prevent a mixture of an inlet air to the air inlet of the first air flow structure and an outlet air from the air outlet of the second air flow structure, and a second external partition plate disposed at an external position outside and between the air inlet of the second air flow structure and the air outlet of the first air flow structure to prevent a mixture of an inlet air to the air inlet of the second air flow structure and an outlet air from the air outlet of the first air flow structure.

9. The image forming apparatus of claim 3, further comprising:

an air supply fan mounted to each of the air inlets of the first and second air flow structures, wherein each of the first and second partition plates is tilted with a predetermined angle in a direction opposite to a rotation direction of the radiating fin to make corresponding one of the air supply paths of the first and second air flow structures gradually narrowed toward the radiating fin to an extent of having a width of half a radius of the radiating fin at an end.

10. A cooling apparatus which cools down a heated recording sheet having a fixed toner image in an image forming apparatus, comprising:

a duct including first and second air flow structures, each including an air inlet, an air supply path, an air exhaust path, and an air outlet, in this order to take in air through the air inlet and to eject the air through the air outlet via the air supply path and the air exhaust path in each of the first and second air flow structures, a radiating fin arranged in the duct between the air supply path and the air exhaust path of each of the first and second air flow structures, and having a plurality of fins each radially extending in parallel to a flow of air in the duct, and a heat pipe having one side connected to the radiating fin and another side arranged in a vicinity to an exit of a toner fixing mechanism of the image forming apparatus, and configured to rotate to draw heat from the heated recording sheet having the fixed toner image, wherein the first and second air flow structures are arranged reversely side by side such that the air inlet, the air supply path, the air exhaust path, and the air outlet of the first air flow structure are adjacent to the air outlet, the air exhaust path, the air supply path, and the air inlet of the second air flow structure, respectively, and such that a flow of air through each of the first and second air flow structures is directed forwards relative to a rotation of the radiating fin and in a same direction as the rotation of the radiating fin.

11. The image forming apparatus of claim 10, wherein the first air flow structure includes a first air supply fan and a first air exhaust fan, and the second air flow structure includes a second air supply fan and a second air exhaust fan.

* * * * *